US007728213B2

(12) United States Patent
Stone et al.

(10) Patent No.: US 7,728,213 B2
(45) Date of Patent: Jun. 1, 2010

(54) SYSTEM AND METHOD FOR DYNAMIC NOTE ASSIGNMENT FOR MUSICAL SYNTHESIZERS

(75) Inventors: Christopher L. Stone, Hidden Hills, CA (US); Gary D. Davis, West Hills, CA (US)

(73) Assignee: The Stone Family Trust of 1992, Hidden Hills, CA (US)

( * ) Notice: Subject to any disclaimer, the term of this patent is extended or adjusted under 35 U.S.C. 154(b) by 536 days.

(21) Appl. No.: 11/411,589

(22) Filed: Apr. 25, 2006

(65) Prior Publication Data

US 2006/0236848 A1 Oct. 26, 2006

Related U.S. Application Data

(63) Continuation-in-part of application No. 10/684,296, filed on Oct. 10, 2003, now Pat. No. 7,109,406.

(51) Int. Cl.
*A63H 5/00* (2006.01)

(52) U.S. Cl. ..... 84/609; 446/408

(58) Field of Classification Search ..... 84/609, 84/622, 645; 446/408

See application file for complete search history.

(56) References Cited

U.S. PATENT DOCUMENTS 4,703,681 A * 11/1987 Okamoto ..... 84/478
5,095,800 A * 3/1992 Matsuda ..... 84/618
5,703,312 A 12/1997 Takahashi et al.
5,998,724 A 12/1999 Takeuchi et al.
6,369,311 B1 * 4/2002 Iwamoto ..... 84/615
7,005,572 B2 2/2006 Fay
7,169,997 B2 1/2007 Kay

OTHER PUBLICATIONS

Authorized Officer: Jeffrey Donels, "International Search Report," International Searching Authority, October 12, 2006, pp. 1-4.
"Garritan Personal Orchestra Ensemble Building," Garritan Orchestral Libraries, http://web.archive.org/web/20041011021446/garritan.com/GPO-ensemble.html, Oct. 11, 2004.
"Garritan Personal Orchestra Controls," Garritan Orchestral Libraries, http://web.archive.org/web/20041011020846/garritan.com/GPO-control.html, Oct. 11, 2004.

(Continued)

*Primary Examiner*—Jianchun Qin
(74) *Attorney, Agent, or Firm*—Nixon Peabody LLP.; Joseph Bach, Esq.

(57) ABSTRACT

An embodiment of the invention creates a method and system for assigning notes to be played by a musical synthesizer to a predetermined number of instrument voices available to be sounded by said musical synthesizer, so that the musical synthesizer may emulate the sound of a live orchestra or other ensemble. The method includes the steps of building an array based on the number of notes to be played and the number of instrument voices available to play such notes, and allocating notes to the voices pursuant to algorithmic determination. As notes are released or newly played, all notes are dynamically reassigned to instrument voices so that, to the extent practicable, all channels play almost all the time. Additional methodology provides for correct assignment of notes across multiple different sections (or types) of instruments for purposes of real time orchestration.

19 Claims, 24 Drawing Sheets

OTHER PUBLICATIONS

"Garritan Orchestra FAQ Page," Garritan Orchestral Libraries, http://www.garritan.com/FAQ.html, Oct. 11, 2004.

"Garritan Personal Orchestra Features," Garritan Orchestral Libraries, http://web.archive.org/web/20041009173443/garritan.com/GPO.html, Oct. 11, 2004.

* cited by examiner

301

Assignment Table, Eight Cello Section
One Note
Top-Weighted

Channel 1: the note on sorted note list
Channel 2: the note on sorted note list
Channel 3: the note on sorted note list
Channel 4: the note on sorted note list
Channel 5: the note on sorted note list
Channel 6: the note on sorted note list
Channel 7: the note on sorted note list
Channel 8: the note on sorted note list

302

Assignment Table, Eight Cello Section
Two Notes
Top-Weighted

Channel 1: the higher note on sorted note list
Channel 2: the higher note on sorted note list
Channel 3: the higher note on sorted note list
Channel 4: the higher note on sorted note list
Channel 5: the lower note on sorted note list
Channel 6: the lower note on sorted note list
Channel 7: the lower note on sorted note list
Channel 8: the lower note on sorted note list

303

Assignment Table, Eight Cello Section
Three Notes
Top-Weighted

Channel 1: the highest note on sorted note list
Channel 2: the highest note on sorted note list
Channel 3: the highest note on sorted note list
Channel 4: the second highest note on sorted note list
Channel 5: the second highest note on sorted note list
Channel 6: the second highest note on sorted note list
Channel 7: the lowest note on sorted note list
Channel 8: the lowest note on sorted note list

304

Assignment Table, Eight Cello Section
Four Notes
Top-Weighted

Channel 1: the highest note on sorted note list
Channel 2: the highest note on sorted note list
Channel 3: the second highest note on sorted note list
Channel 4: the second highest note on sorted note list
Channel 5: the third highest note on sorted note list
Channel 6: the third highest note on sorted note list
Channel 7: the lowest note on sorted note list
Channel 8: the lowest note on sorted note list

305

Assignment Table, Eight Cello Section
Five Notes
Top-Weighted

Channel 1: the highest note on sorted note list
Channel 2: the highest note on sorted note list
Channel 3: the second highest note on sorted note list
Channel 4: the second highest note on sorted note list
Channel 5: the third highest note on sorted note list
Channel 6: the third highest note on sorted note list
Channel 7: the fourth highest note on sorted note list
Channel 8: the lowest note on sorted note list

306

Assignment Table, Eight Cello Section
Six Notes
Top-Weighted

Channel 1: the highest note on sorted note list
Channel 2: the highest note on sorted note list
Channel 3: the second highest note on sorted note list
Channel 4: the second highest note on sorted note list
Channel 5: the third highest note on sorted note list
Channel 6: the fourth highest note on sorted note list
Channel 7: the fifth highest note on sorted note list
Channel 8: the lowest note on sorted note list

307

Assignment Table, Eight Cello Section
Seven Notes
Top-Weighted

Channel 1: the highest note on sorted note list
Channel 2: the highest note on sorted note list
Channel 3: the second highest note on sorted note list
Channel 4: the third highest note on sorted note list
Channel 5: the fourth highest note on sorted note list
Channel 6: the fifth highest note on sorted note list
Channel 7: the sixth highest note on sorted note list
Channel 8: the lowest note on sorted note list

308

Assignment Table, Eight Cello Section
Eight Notes
Top-Weighted

Channel 1: the highest note on sorted note list
Channel 2: the second highest note on sorted note list
Channel 3: the third highest note on sorted note list
Channel 4: the fourth highest note on sorted note list
Channel 5: the fifth highest note on sorted note list
Channel 6: the sixth highest note on sorted note list
Channel 7: the seventh highest note on sorted note list
Channel 8: the lowest note on sorted note list

Fig. 3

*Subtractive Divisi Process - Soft Attacks (continued)*

SYSTEM AND METHOD FOR DYNAMIC NOTE ASSIGNMENT FOR MUSICAL SYNTHESIZERS

RELATED APPLICATIONS

This application is a continuation-in-part of patent application Ser. No. 10/684,296, filed Oct. 10, 2003, now U.S. Pat. No. 7,109,406 and published as 2005-0076770A1, and which is incorporated herein in its entirety.

TECHNICAL FIELD

This invention relates to the playing or orchestration of musical material on a sample-based or synthesizer-based instrument in a way that dynamically assigns individual note reproduction to simulate the manner in which a given number of live musical instruments would play a musical selection. The same note assignment methods described here may equally be applied to the generation of musical scores for orchestration, or for generating stored note-playing data for subsequent generation of synthesized sound or orchestration.

BACKGROUND

There are fundamentally two categories of musical synthesizers: (a) samplers (or "sampling synthesizers"), in which stored digitized recordings (or samples) of actual instruments are reproduced when notes are played on a keyboard connected to the sampler, and (b) synthesizers, in which sounds are created at the time they are played based on analog or digital electronic circuitry which creates the sound without reliance upon previously recorded actual instruments. These instruments today are predominantly polyphonic, meaning they can play more than one note at a time. While the nature of the invention is immediately more applicable to samplers, it will function in connection with synthesizers as well. For simplicity the discussion herein will focus primarily on sampling applications.

Current electronic musical instruments are predominantly sample-players, which means they play specially processed digital recordings of sounds in response to some sort of control input, typically a musical keyboard or a sequencer. In simple terms a sequencer is like a digital version of a player piano giving instructions to the sample player (or other electronic instrument) on which notes to play and how to play them. For the purpose of the instant invention, it doesn't matter whether a "real time" keyboard or other musical controller or a sequencer is used to play notes on the synthesizer. There are synthesizers in which waveforms are generated and/or manipulated to create sounds without any reference to actual recorded sounds (such as additive waveform synthesizers, fm-modulating synthesizers, and wave table lookup synthesizers, among others); these were the original types of synthesizers. Later, as digital audio technology developed and became affordable, samplers or sampling synthesizers became popular; for samplers, actual recordings of sounds are specially processed into files that are stored on digital media for later playback that emulates the original recorded acoustic instruments (or other sound sources).

Sampled sounds are sold in collections, or libraries, and the individual sounds in sample libraries may be created from recordings of one or several instruments. With ensemble instruments such as bands and orchestras, it is common for a group of similar instruments to be recorded together; this "multi-instrument" sound is saved as a single sample. Thus, a prior-art sample of the first violin section of a symphony orchestra may consist of a recording of sixteen violins playing the same note, and these same sixteen violins would then play another note, and the collection of such notes would be packaged and identified, for example, as the "XYZ first violin sample library."

Depending upon the nature of the technology used in a prior art sampler, there may be a separate source recording (initial sample) in its library for each note the sampler is capable of reproducing, or a single note sample may be electronically interpolated to higher and lower pitches corresponding to various notes. The first option yields optimum sound quality, at maximum cost and complexity, to create the library and reproduce it in the sampler, whereas the second option yields lesser sound quality at a reduced cost and complexity.

When samples are initially recorded, there may be one or many instruments actually playing the sound (and each may be playing one or more notes). Typically with orchestral or large band sounds, entire sections of instruments play each sampled note, with all instruments in a given section concurrently playing a single note. Thus, in the prior art a sample of an orchestra section of eight cellos would be a single recording of eight cello players playing the same note. When this sample of one note is played back on a sampler, all eight instruments are heard playing the same note. Similarly, a sample of an orchestra section of sixteen violins would be made by recording sixteen individual violin players all concurrently playing the same note, and when this sample is played back the sound of all sixteen violins would be heard playing that note concurrently.

When prior art samples of sixteen violins are played back in a sampler, if the person playing presses one key on the keyboard (or otherwise causes one note to be played), the sound that comes out of the sampler is the sound of all sixteen violins playing that note. So far, this may be very close to what would be heard in an actual symphony hall where, if the conductor (or musical score) instructs the first violins to play that same note, all sixteen will play that note.

However, if the person playing the sampler with this prior art violin sample presses two notes on the keyboard (or otherwise causes two notes to be played), the sound that comes out of the sampler is the sound of all sixteen violins playing each of the two notes; i.e., one hears 32 violins playing; this is what is called "additive polyphony." Additive polyphony is not what would be heard with an actual symphony because in that case (with our example) there are only 16 violinists present, not 32. In fact, when a conductor (or musical score) instructs such a first violin section to play two notes, half of the players (eight of them) will play the one note and the other half (the remaining eight) will play the second note.

If there are three notes to be played at once, the available players are split up into three groups, each group playing one of those notes. With sixteen players and three notes, obviously the division is not equal, so it would typically be done with one note assigned to 6 players, and each remaining note assigned to 5 players each. This is what is called "subtractive polyphony."

When the number of players available cannot be evenly distributed among the number of notes being played, a choice must be made as to where the "extra" player or players are assigned. This choice can be considered to be top weighted if the extra player(s) play the highest note(s) or bottom weighted if the extra player(s) play the lowest notes(s). With live acoustic performers, the allocation decisions affecting which notes are given to available players is done through a process known as "divisi," and the instructions for such divisi are created by any of several parties involved with the music creation. Any combination of the composer, a musical arranger, the conductor and the "first chair" player of the particular section of instruments typically decide who plays which notes; divisi is not an exact science or protocol in music, but it is a well-established and essential principle guiding live performances wherein more than one player of a particular type of instrument are playing at once.

As noted above, the prior art, when multiple notes are concurrently played on a sampler, multiple instances of the sampled recording are sounded. Thus, if one has a cello sample in the library made from eight cellos, and two notes are played together on the sampler, the sampler would play the sound of sixteen cellos playing, eight instruments per note. If one plays a triad (i.e., three notes concurrently) on the sampler, the sampler would play the sound of twenty-four cellos (i.e., three times the eight cellos per sample). Although this is what is available in professional studios, it results in an unrealistic sound quality which does not reflect how an actual orchestra would sound. By way of example, with a real orchestra, the power (or volume) of a cello section stays relatively constant whether the cello players play one or several notes simultaneously (e.g., the power is about the same whether eight cellists of an eight cello orchestra section all play the same note or if five are playing one note while three are playing a different note). With a prior art sampler, the power is multiplied approximately by the number of notes played. By way of another example, as more and more notes are played simultaneously with a sampler, the density of the harmonics sounded tends to create an organ-like effect rather than preserve the clarity and concise sound definition afforded by a reasonable and fixed number of instruments playing at once. (Note that there may be valid reasons to use additive polyphony, but optimum orchestral sound is not obtained using additive polyphony exclusively.)

The method by which prior art samples are implemented does not include any provision for automatic allocation of individual notes among a fixed number of players. Most conventional sample libraries have multiple players "built in" to a given sound sample and so the "additive polyphony" employed in typical samplers cause more instruments to be heard the more notes that are played at the same time. This causes the sound power to multiply with each note played (three notes played using a sixteen-violin sample will sound like the first violin section has suddenly grown to 48 players). For this reason, anyone who has tried to attain realistic or even usable "orchestral balances" using prior art samplers and sample libraries has had to constantly "ride gain" or adjust the volume level of the performance to compensate for the power build up with greater numbers of notes; such "gain riding" may alternately be done by skilful playing on a velocity-sensitive keyboard, but this can be an exhausting effort. In a "real" orchestra or other ensemble, such sound power (volume) build-up does not occur because no matter how many notes are played, there are only a fixed number of musicians and instruments on stage performing.

The realism of sampled sound also depends upon correct conveyance of the harmonic structure. Each instrument as played by a given musician produces its own unique timbre (harmonic structure) and these various harmonics together create the texture of the sound that is heard. With a fixed number of instruments constantly reallocated to whatever number of notes are being played (the "live" situation), these unique timbres are all present, but only one per instrument, and so the combined harmonic structure has a distinct and discernable quality to a trained ear. However, when this full set of instruments also play the next note and the next and so forth all at one time (the prior art sampler situation), the harmonic structures of these multiple sets of instruments playing various notes overlay one another, and the unique timbres are no longer discernable. The resulting sound may be described as "dense," "organ-like," or "muddy," and no amount of volume control adjustment can remedy this unrealistic harmonic structure.

What is needed to improve the realism of sampled or synthesized musical performances is a way to allocate the notes played to individual instruments or to small groups of instruments, changing the allocations in accordance with the number of notes being sounded at any given time. That is the nature of the methods presented herein.

SUMMARY

Various embodiments of the invention relate to methods and systems for assigning notes to be played by a musical synthesizer to a predetermined number of channels of said musical synthesizer, so that the musical synthesizer may emulate the note allocation of a live orchestra section. The method includes the steps of selecting a note/channel assignment table corresponding to the number of notes to be played and the number of channels allocated to the playing of such notes, and assigning notes to the channels pursuant to the assignment table. The number of channels would typically be the same as the number of instruments in the orchestra section being emulated As new note events occur, notes are dynamically reassigned to channels so that hard and soft attacks are taken into account and, to the extent practicable, each channel plays a single note at a time.

Various embodiments of the invention also relate to methods and systems for assigning notes to be played by a musical synthesizer to a predetermined number of voices (where a "voice" nominally represents one or several instruments) of the musical synthesizer, so that the musical synthesizer may emulate the note allocation among musicians of a section within a live orchestra. The method, which the authors refer to as "subtractive divisi," includes the steps of pre-assigning voices (whether single or multiple instruments) to different channels so they can be addressed discretely (this presupposes the voices have been created as individual instruments or small clusters of them, rather than whole sections of instruments as was common in prior art libraries of sounds), pre-assigning other parameters as well (such as priority, top or bottom weighting), calculating in real time the assignment of notes to each of the available voices, and reassignment of voices whenever the specific notes playing change. The number of channels would typically be the same as the number of instruments (or, for example, small groups of instruments, depending on the resolution of the sampled voices) in the orchestra section or other ensemble being emulated. Note events are defined per current industry practice, and the significant events for this process are note-on's (an added note is played) and note-off's (a note is no longer played). As new note events occur, notes are dynamically reassigned to channels so that as a basic function, each channel plays a single note at a time. Additional provisions of the invention deal with situations when more notes are played than there are available voices (which is referred to herein as "overflow"), and how to reallocate a channel (or channels) that had been sounding a given note which is subsequently released while other notes of a chord continue to sound.

The various embodiment for subtractive divisi provide dynamic note allocation and being accomplished by means of lookup tables or algorithmic methods, for example. Various embodiments also provide methods for handling overflowed notes (notes exceeding in quantity the number of voices available) which method preserves a better orchestral balance. The basic subtractive divisi functions are embodied in several exemplary processes herein, including variations for top and bottom weighting and for note overflow. Also presented herein are an alternative set of processes for what the authors refer to as "additive divisi" which in a novel way can perform real time orchestration among multiple instrument sections. Additive divisi serves more of an orchestrator function than it does an orchestral balancing function; however, it is a procedure for dividing or assigning notes and it may invoke subtractive divisi in an overflow situation so we retain the term "divisi" in this context as well. Additive Divisi provides an ordering procedure for sequentially joining instruments into a composition, which order is determined by means of assigning "additive priority" values to the available instrument sections (designated by means of additive divisi paths). Additive Divisi with Overflow provides the means for distributing notes when the number of notes exceeds the number of additive priority settings one has established for the additive divisi paths.

BRIEF DESCRIPTIONS OF THE DRAWINGS

FIG. 1 is a schematic drawing of an embodiment of the present invention.

FIGS. 2*a* and 2*b* are a flow diagram showing the Note Allocation Routine of the present invention.

FIG. 3 is a sample set of assignment tables.

Figure 5A:
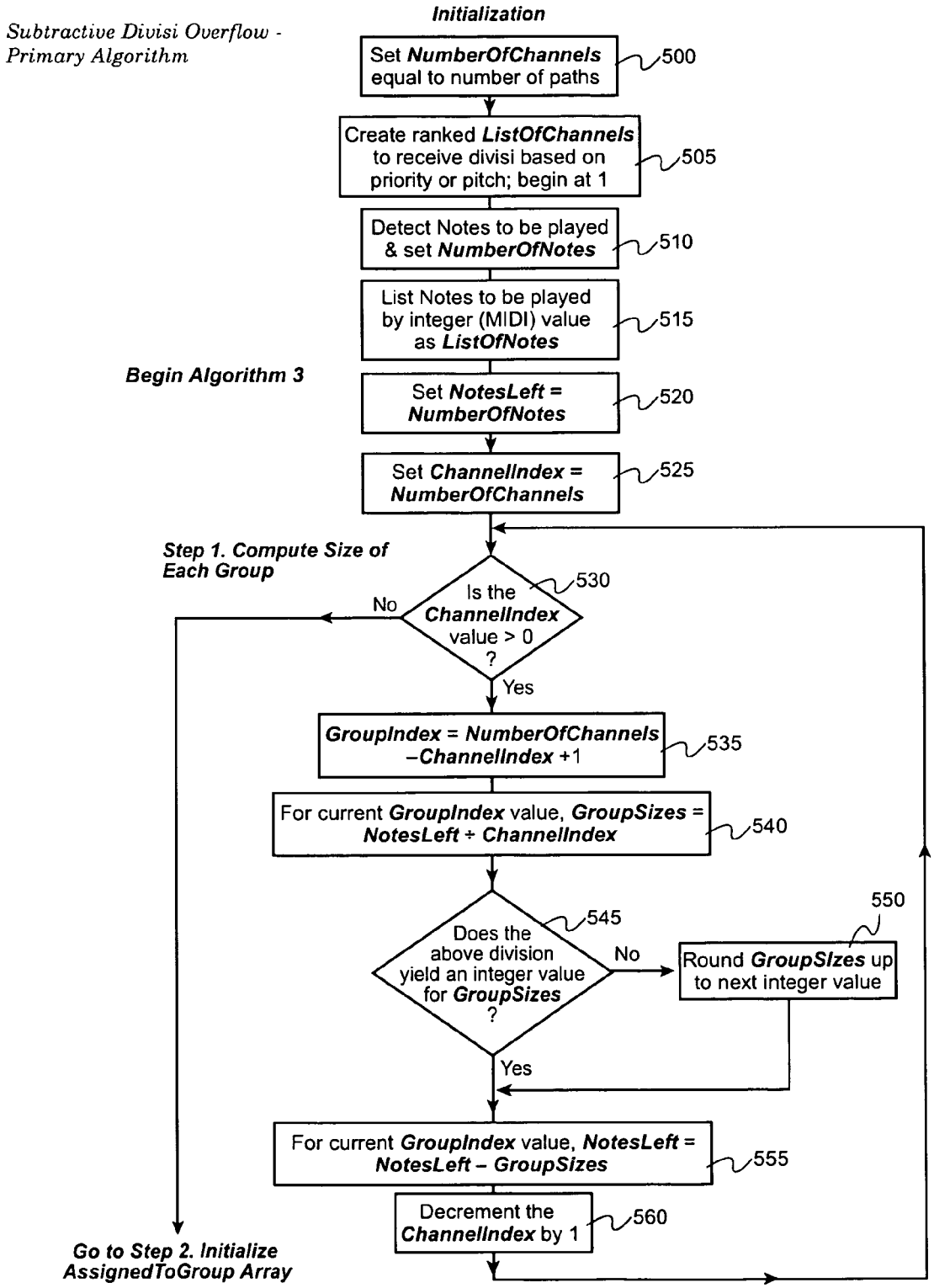

FIG. 5*a* is a flow chart for a process of the method for the first of 5 steps in the main procedure for dealing with top or bottom-weighted subtractive divisi when there are more notes than the number of paths (i.e., when a note overflow condition exists).

Figure 5B:
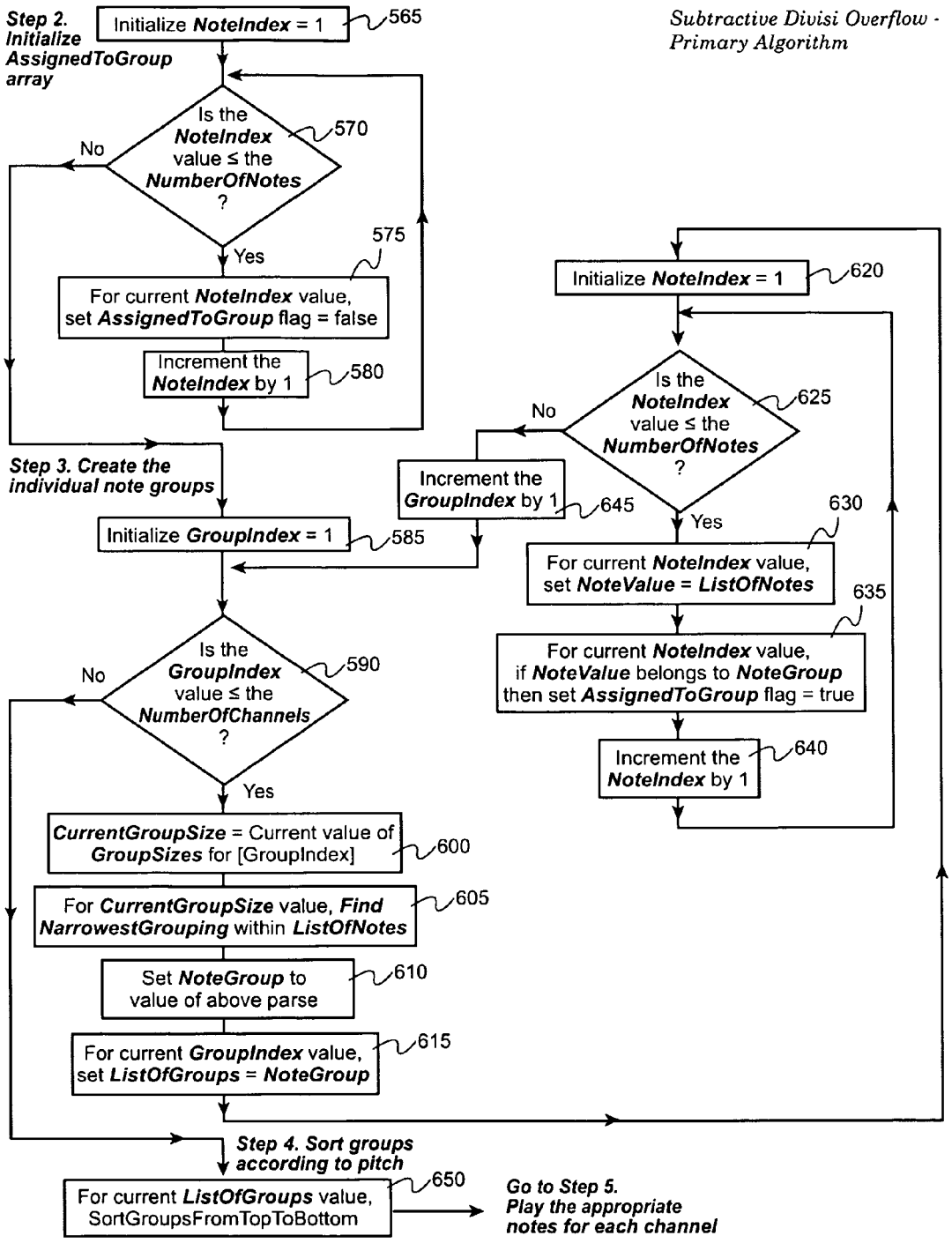

FIG. 5*b* is a flow chart for a process of the method for the second through fourth of 5 steps in the main procedure for dealing with top or bottom-weighted subtractive divisi when there are more notes than the number of paths (i.e., when a note overflow condition exists).

Figure 5C:
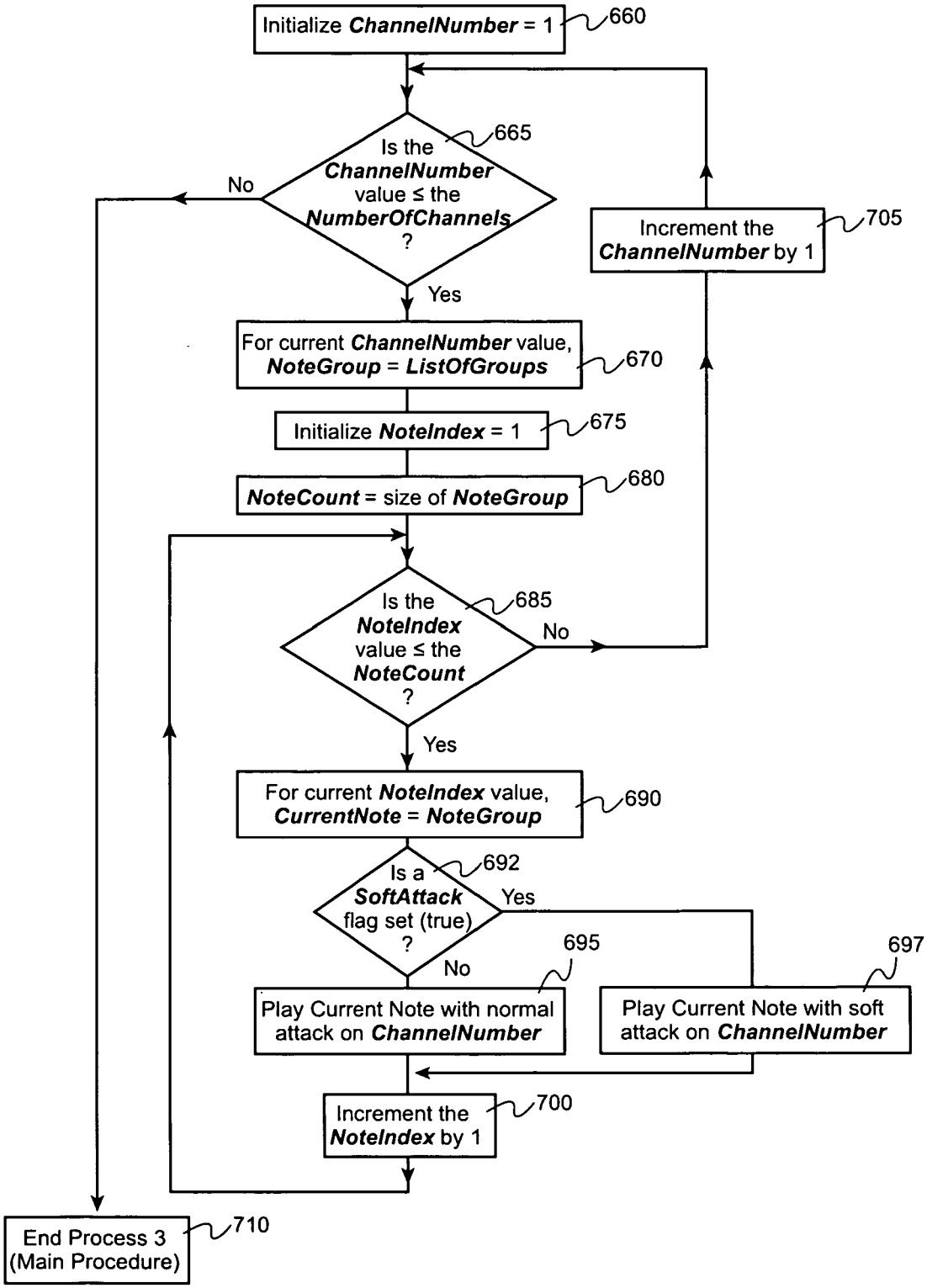

FIG. 5*c* is a flow chart for a process of the method for the last of 5 steps in the main procedure for dealing with top or bottom-weighted subtractive divisi when there are more notes than the number of paths (i.e., when a note overflow condition exists).

Figure 6A:
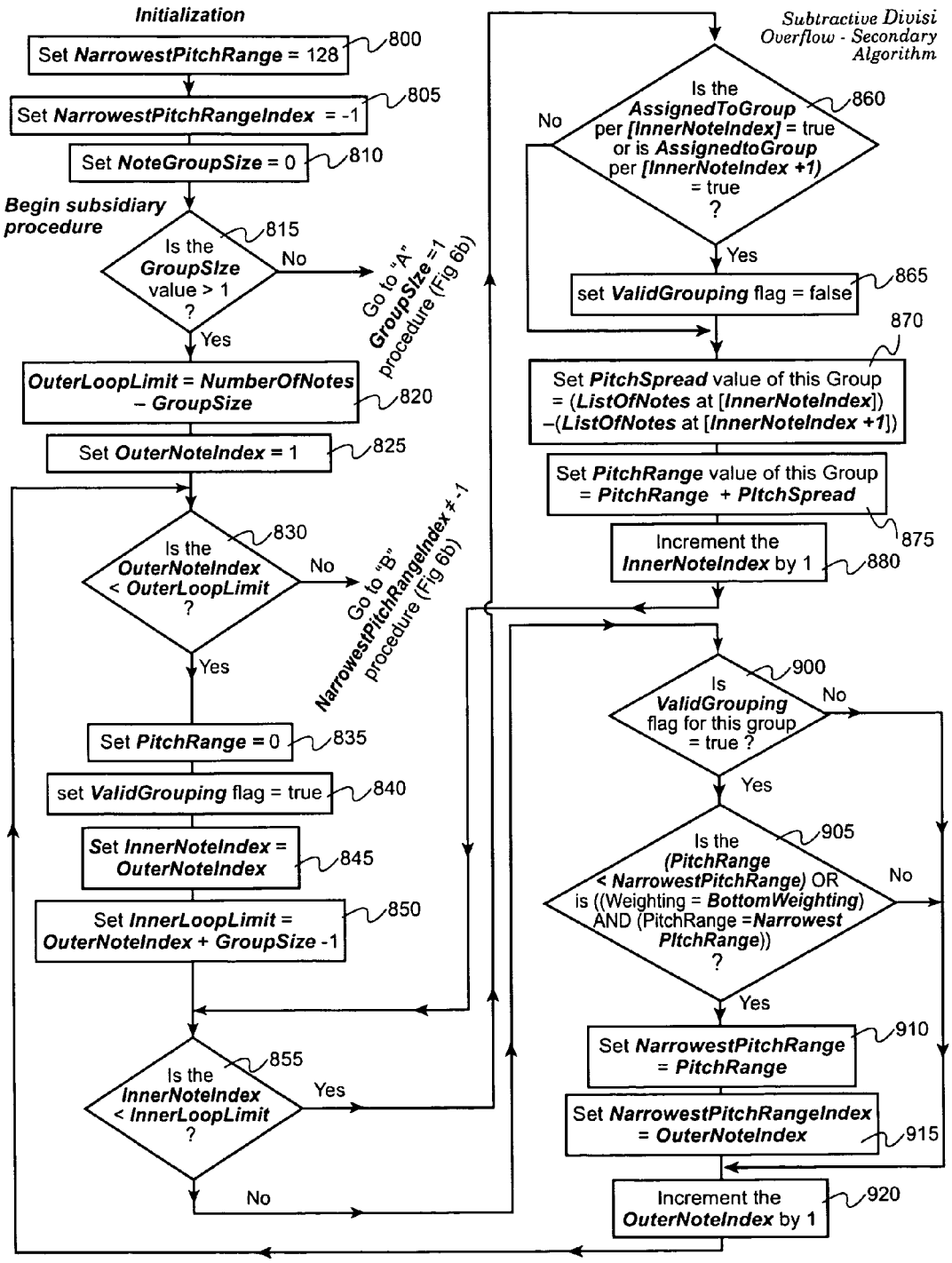

FIG. 6*a* is a flow chart for a process of a subsidiary procedure which is a detailed explanation of the method cited in FIG. 5*b* for figuring out which notes comprise the narrowest pitch range within the note group size being allocated.

Figure 6B:
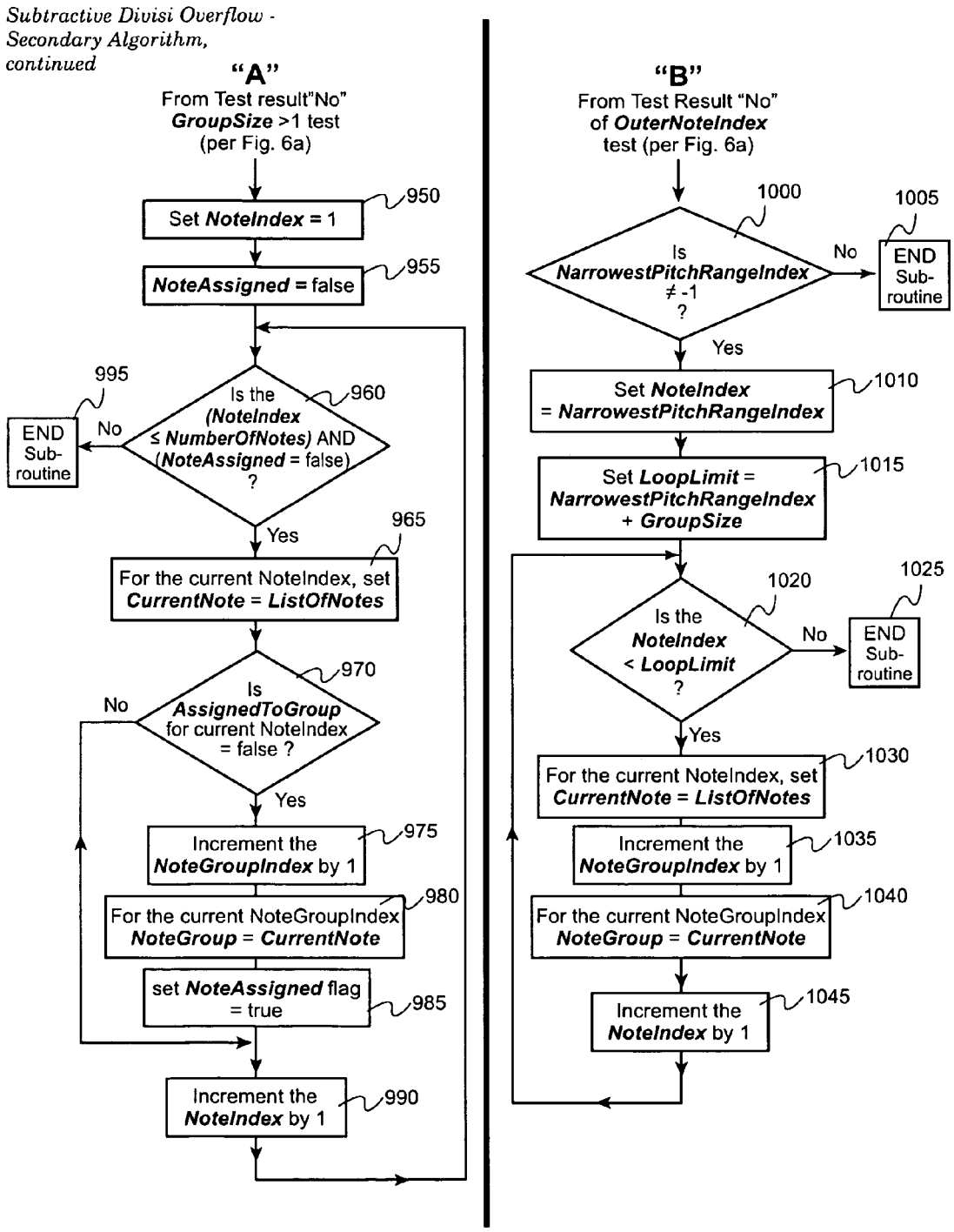

FIG. 6*b* is a flow chart for a process of two further subsidiary procedures that are branches based on "No" returns from decision boxes in FIG. 6*a*.

Figure 7:
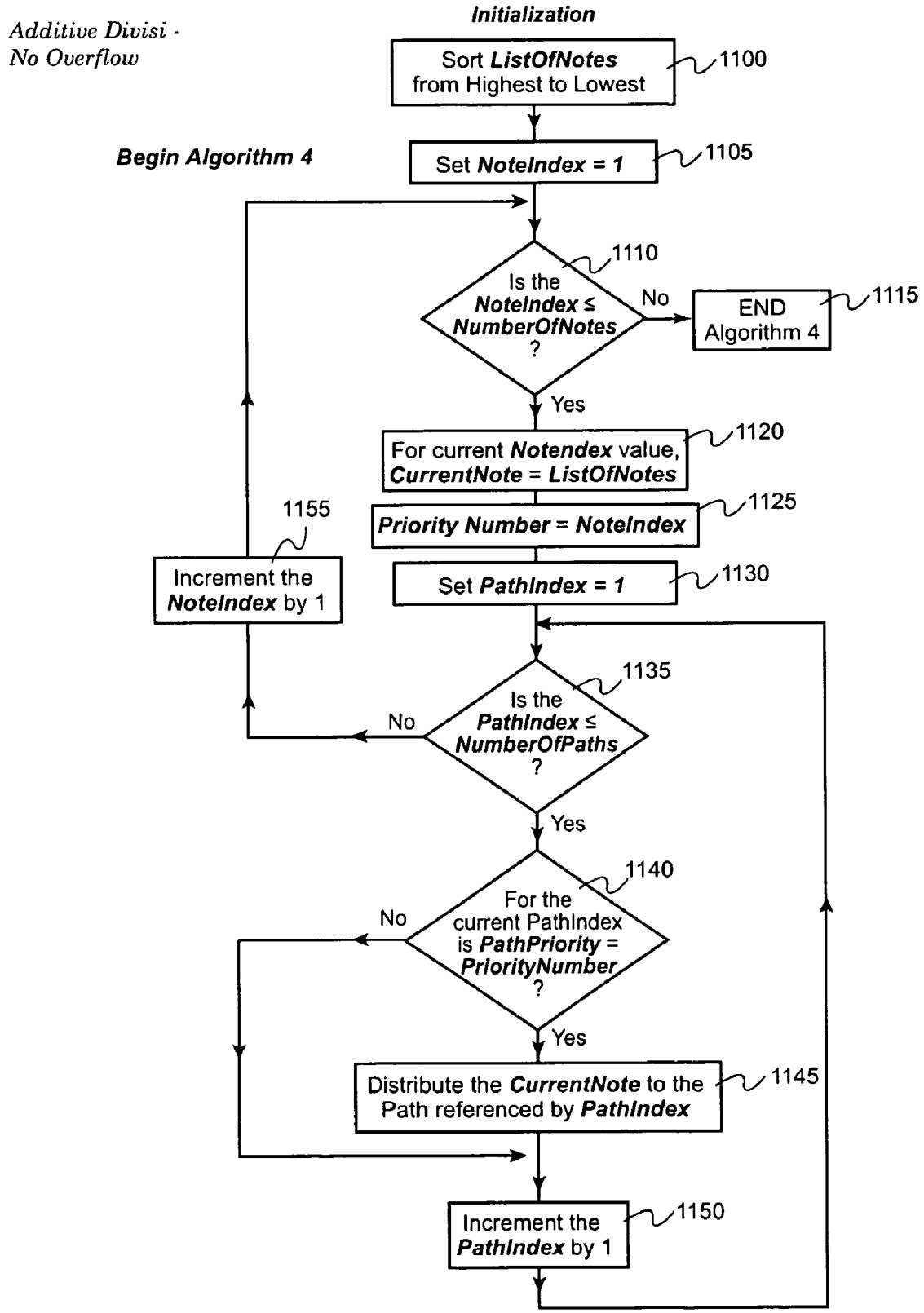

FIG. 7 is a flow chart for a process of the method for the main procedure for dealing with additive divisi when there are no more notes than the number of paths (i.e., when no note overflow condition exists).

Figure 8A:
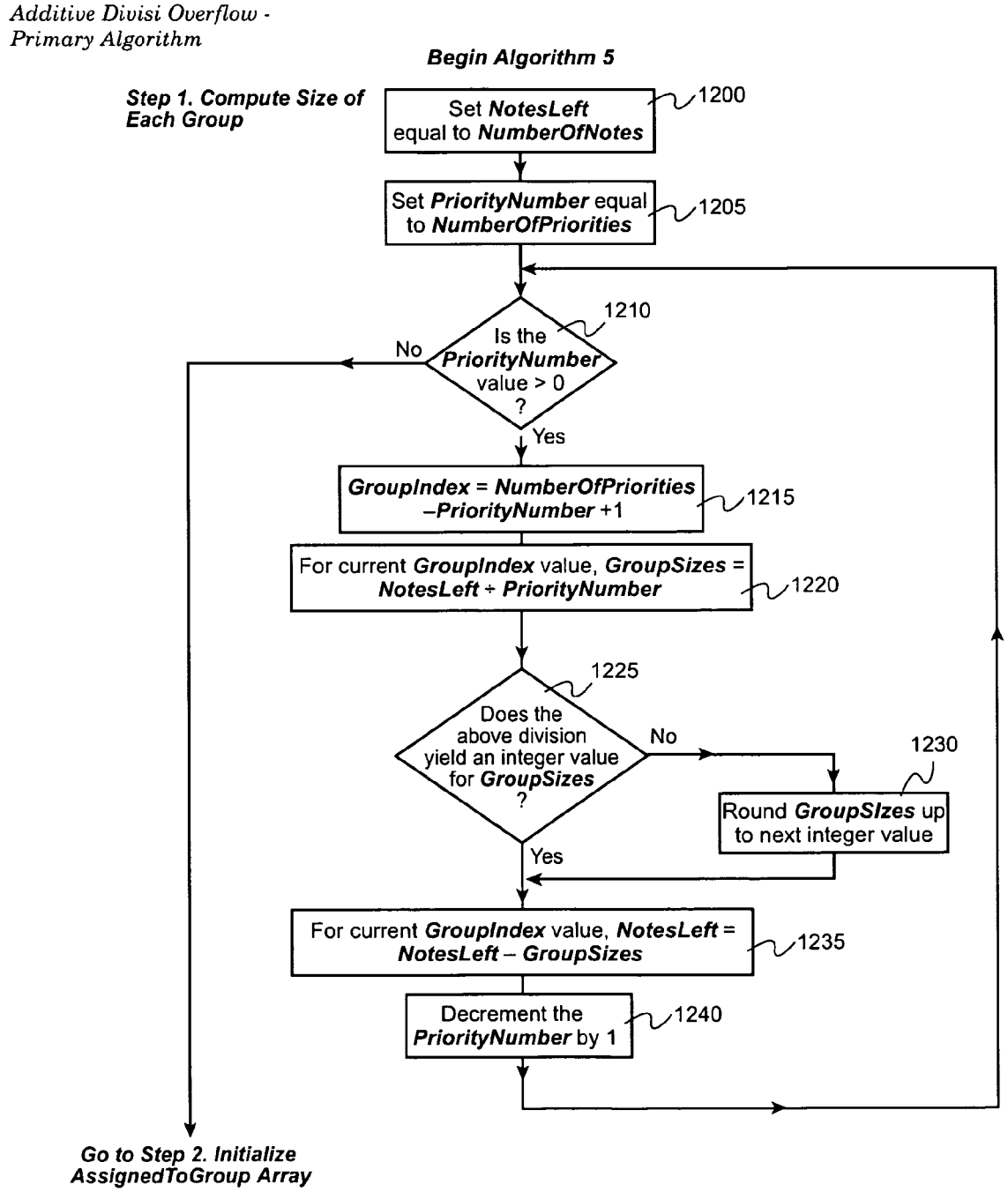

FIG. 8*a* is a flow chart for a process of the first step in the method for accomplishing additive divisi when there are more notes than the number of set priorities (i.e., when a note overflow condition exists) in which the size of each note group is established.

Figure 8B:
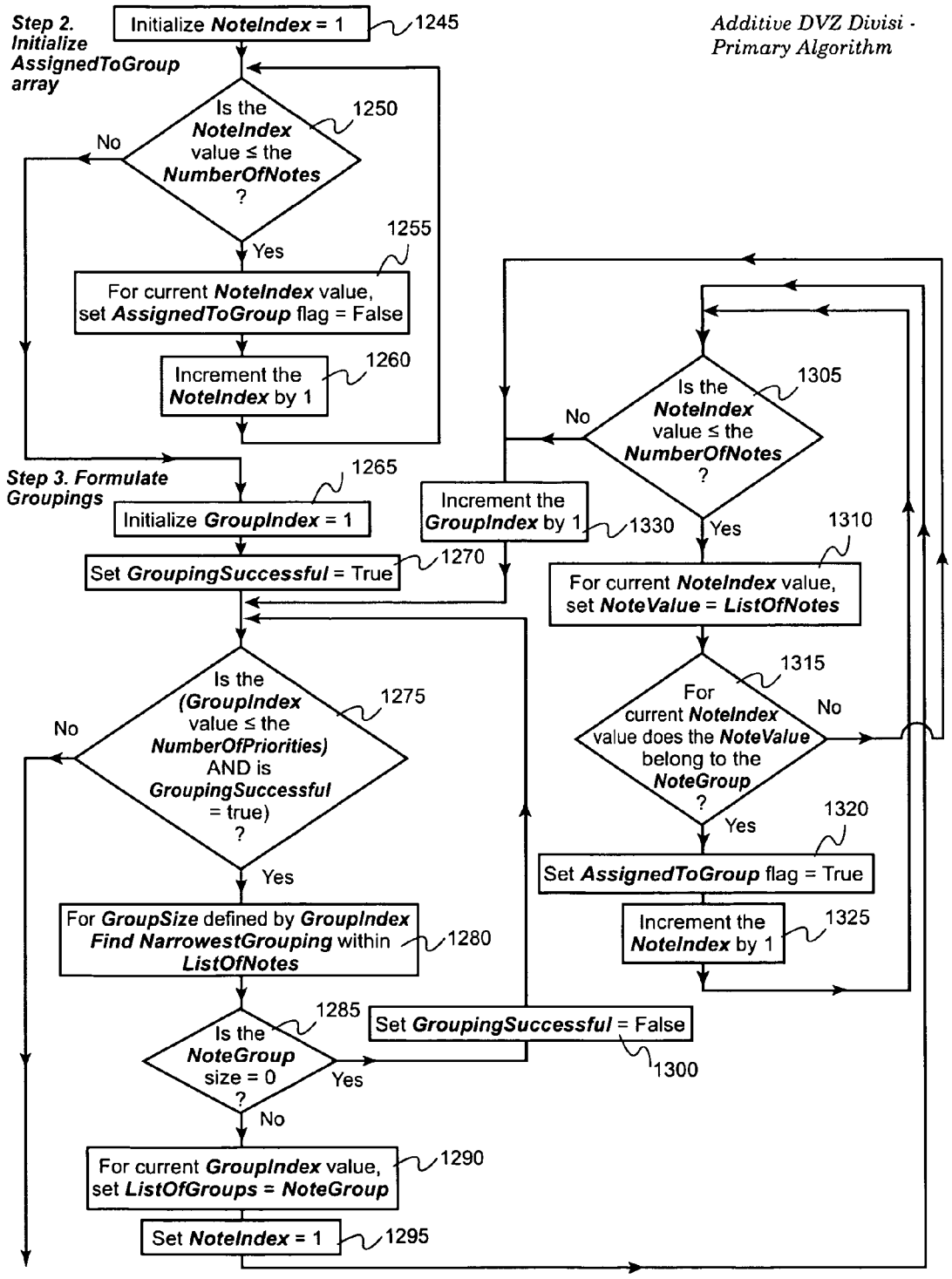

FIG. 8*b* is a flow chart for a process of the second step in which a group array is initialized and the third step in which the notes are assigned to groups, still within the method for accomplishing additive divisi when there is note overflow.

Figure 8C:
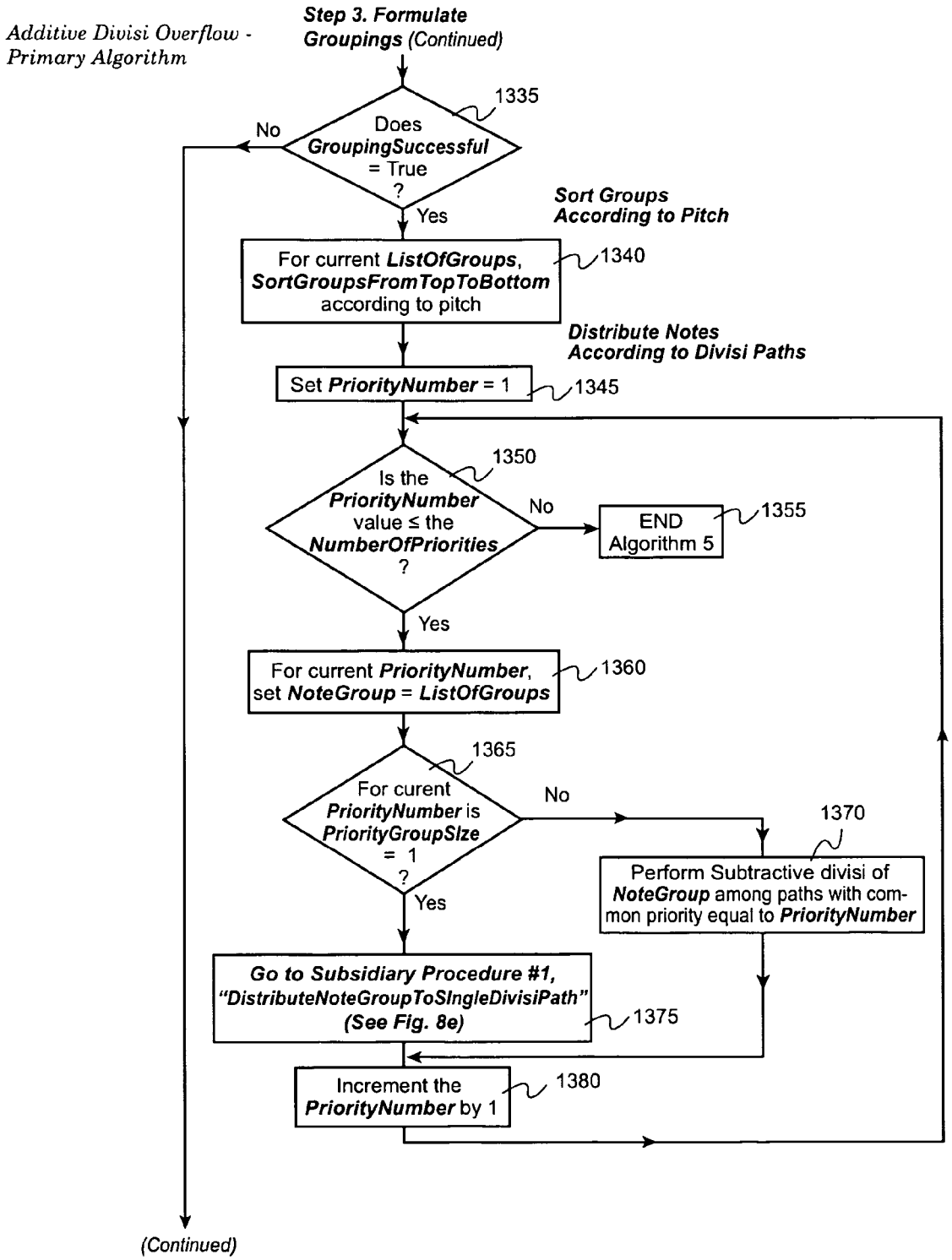

FIG. 8*c* is a flow chart for a process of the remaining primary procedure of the third step of assigning notes to groups when a note overflow condition exists.

Figure 8D:
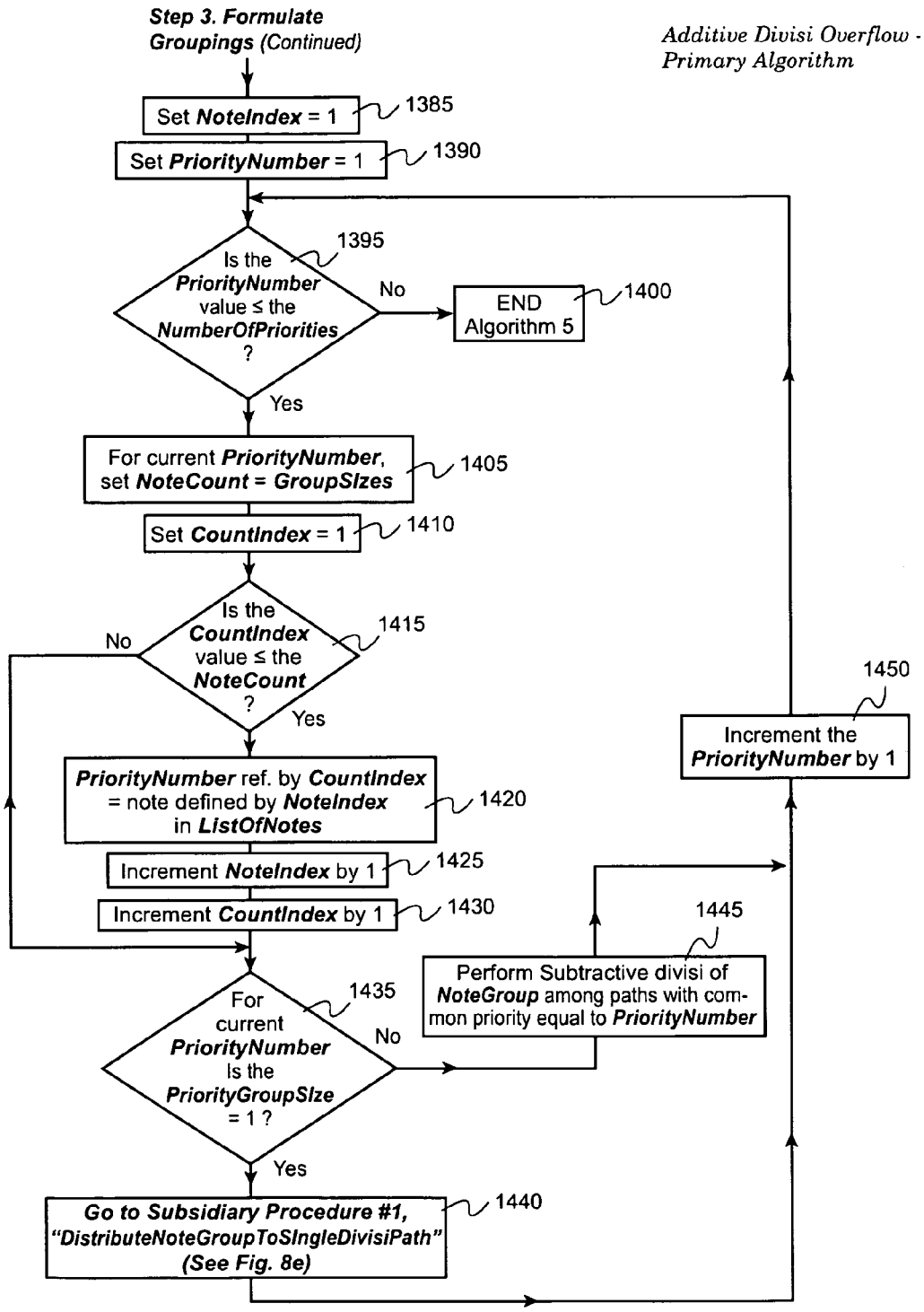

FIG. 8*d* is a flow chart for a process of a branch of the third step in the method for accomplishing additive divisi with note overflow wherein groups are sorted by pitch of contained notes and notes are assigned to paths according to priorities.

Figure 8E:
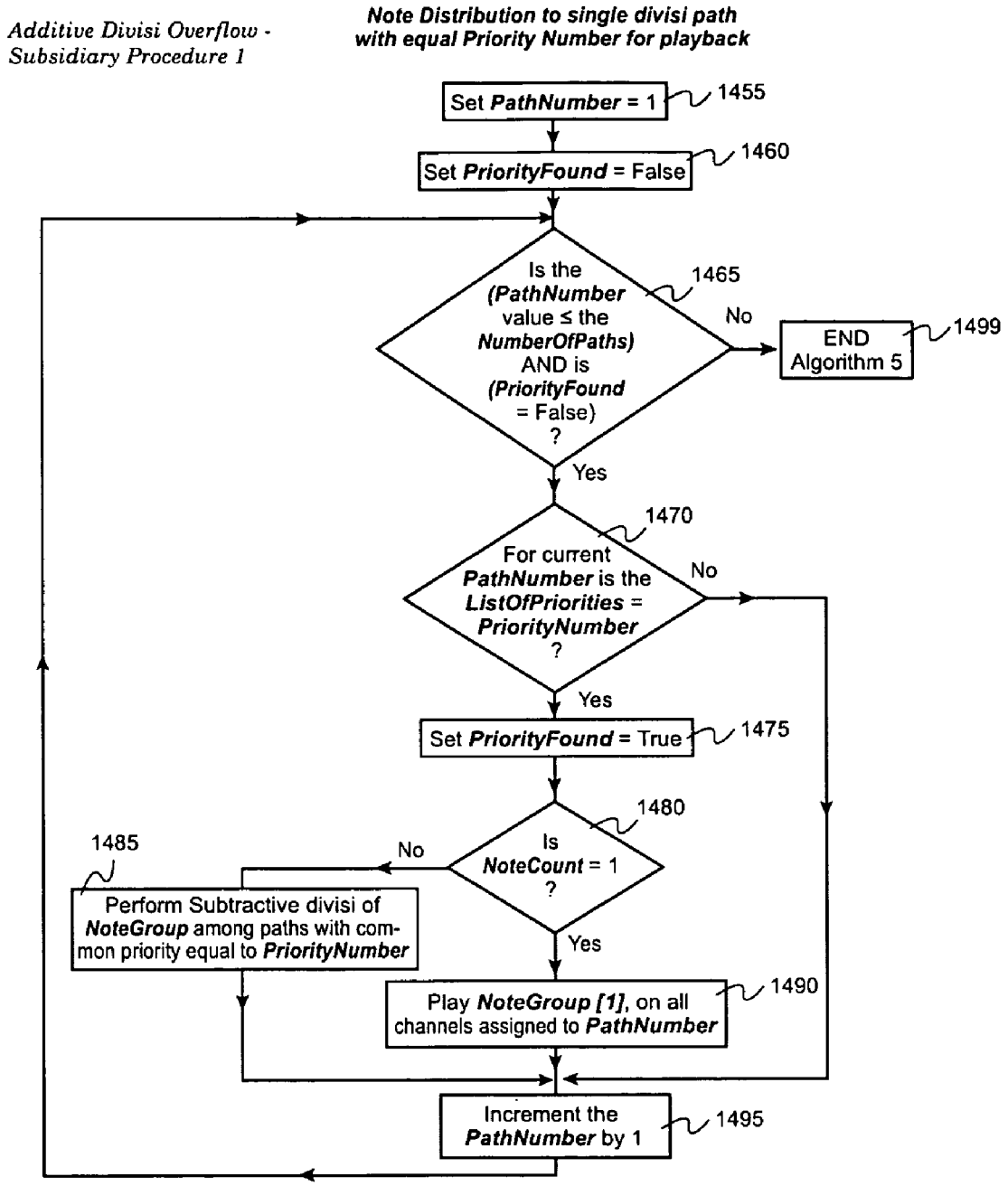

FIG. 8*e* is a flow chart for a process of a subsidiary procedure branching from the third step in the method for accomplishing additive divisi with overflow wherein notes are distributed to a single divisi path with equal playback priority.

Figure 9A:
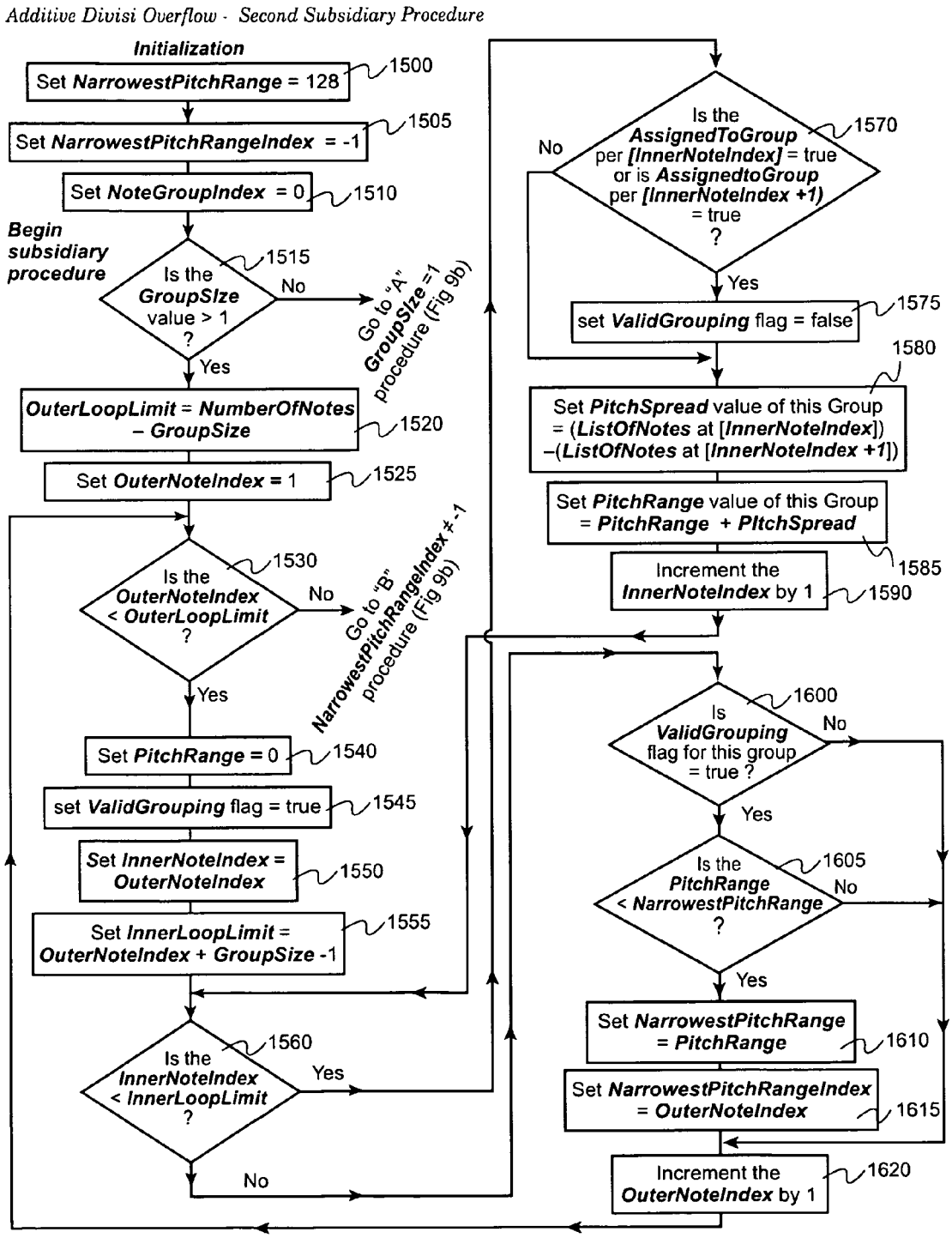

FIG. 9*a* is a flow chart for a process of a subsidiary procedure which is a detailed explanation of the method cited in FIG. 8*b* for figuring out which notes comprise the narrowest pitch range within the note group size being allocated.

Figure 9B:
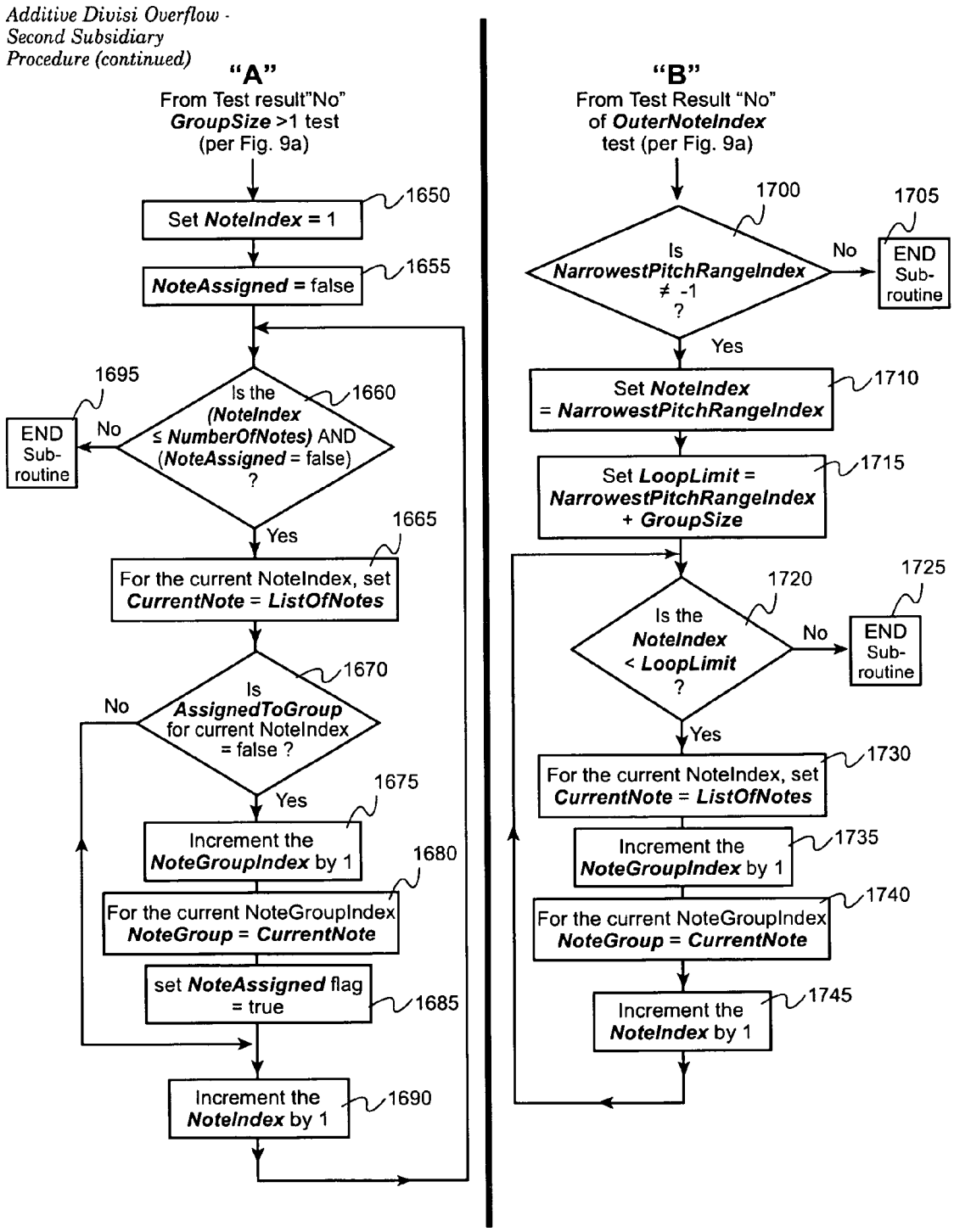

FIG. 9*b* is a flow chart for a process of two further subsidiary procedures that are branches based on "No" returns from decision boxes in FIG. 9*a*.

Figure 10A:
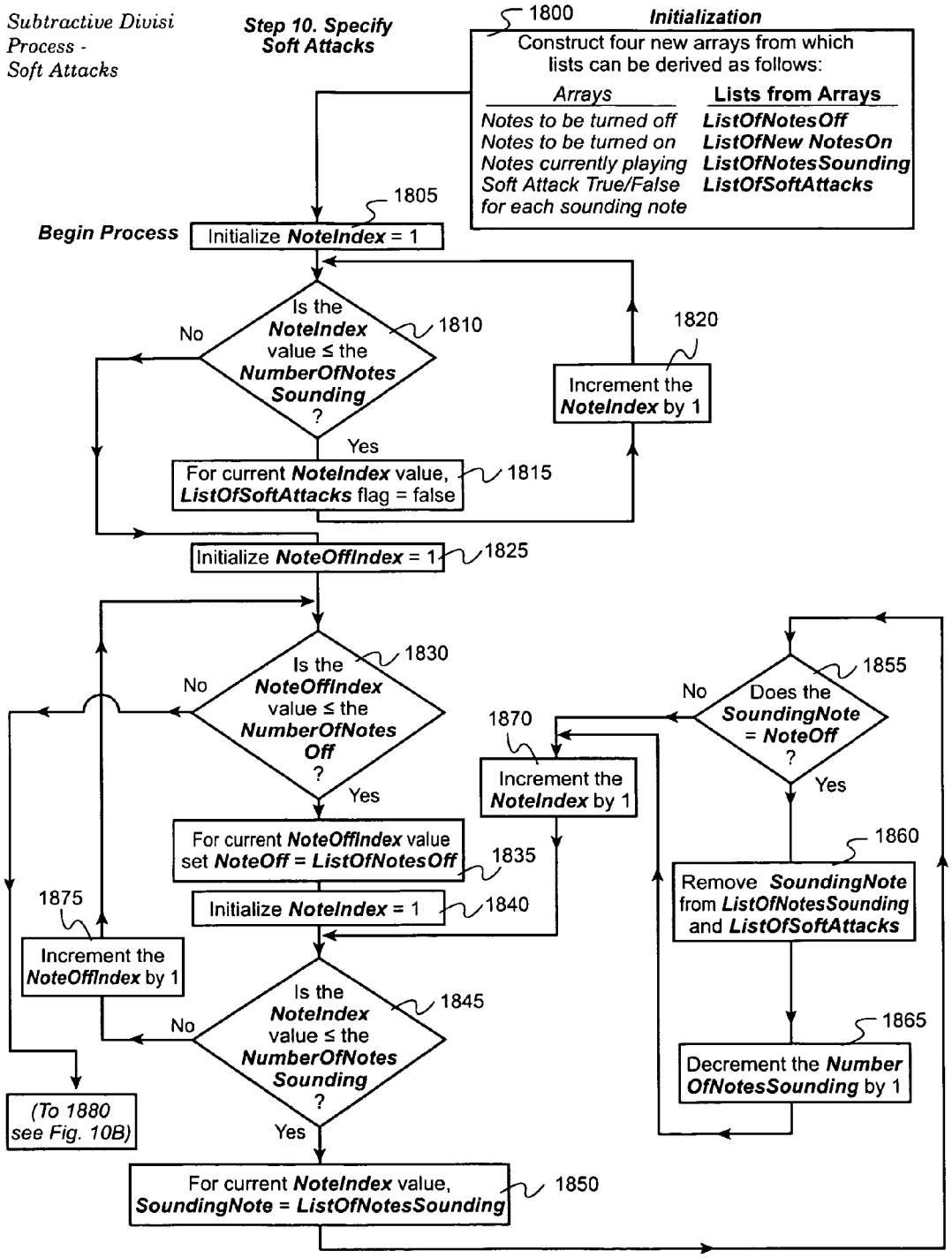
Figure 10B:
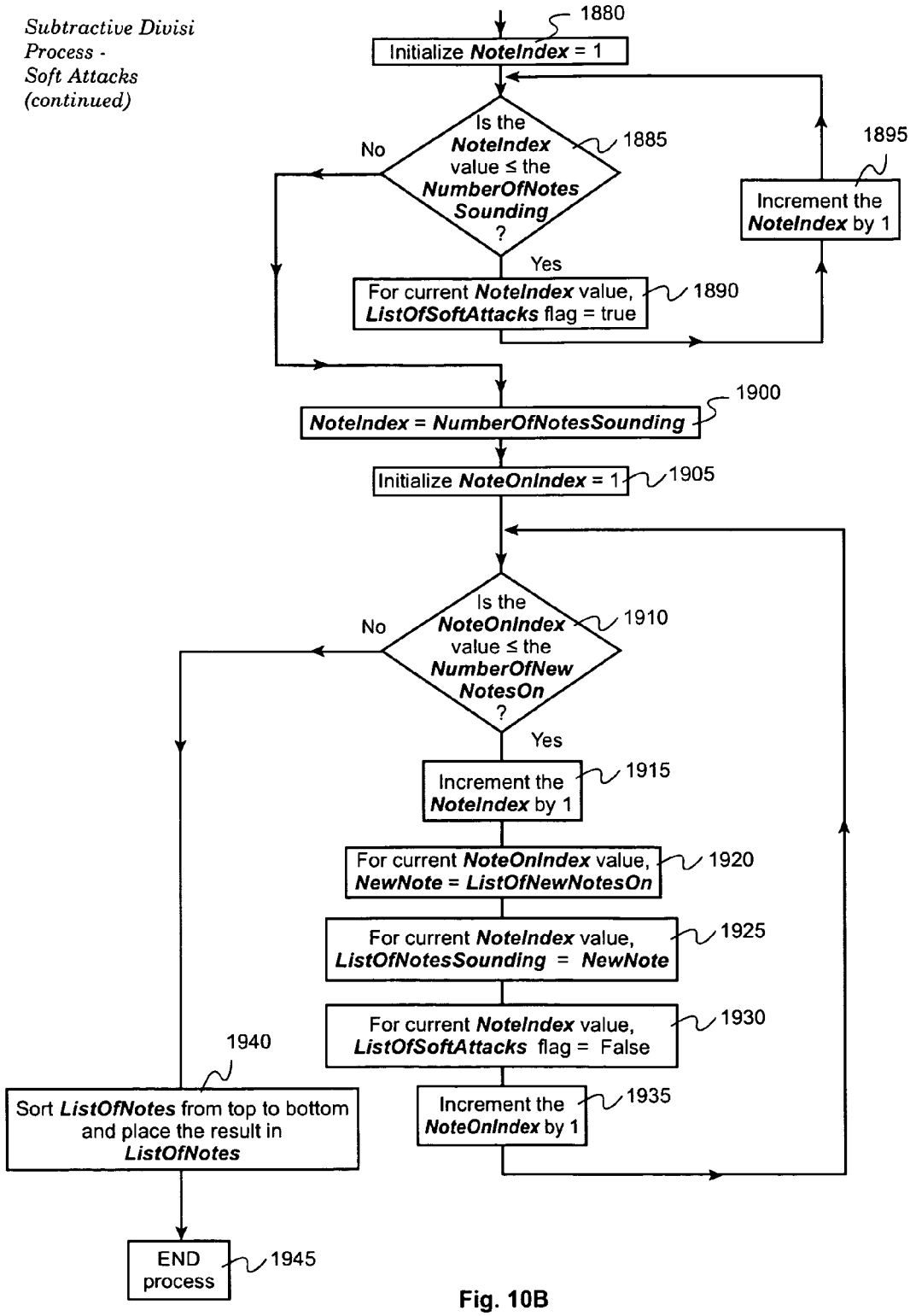

FIGS. 10A and 10B is a depiction of how the system of subtractive divisi determines whether a note should be played with a normal attack or a soft attack. This is an expansion of the brief references to parts of the normal/soft attack method cited in FIGS. 4A, 4B, 4C, 4D, 5A, and 5C.

Figure 11:
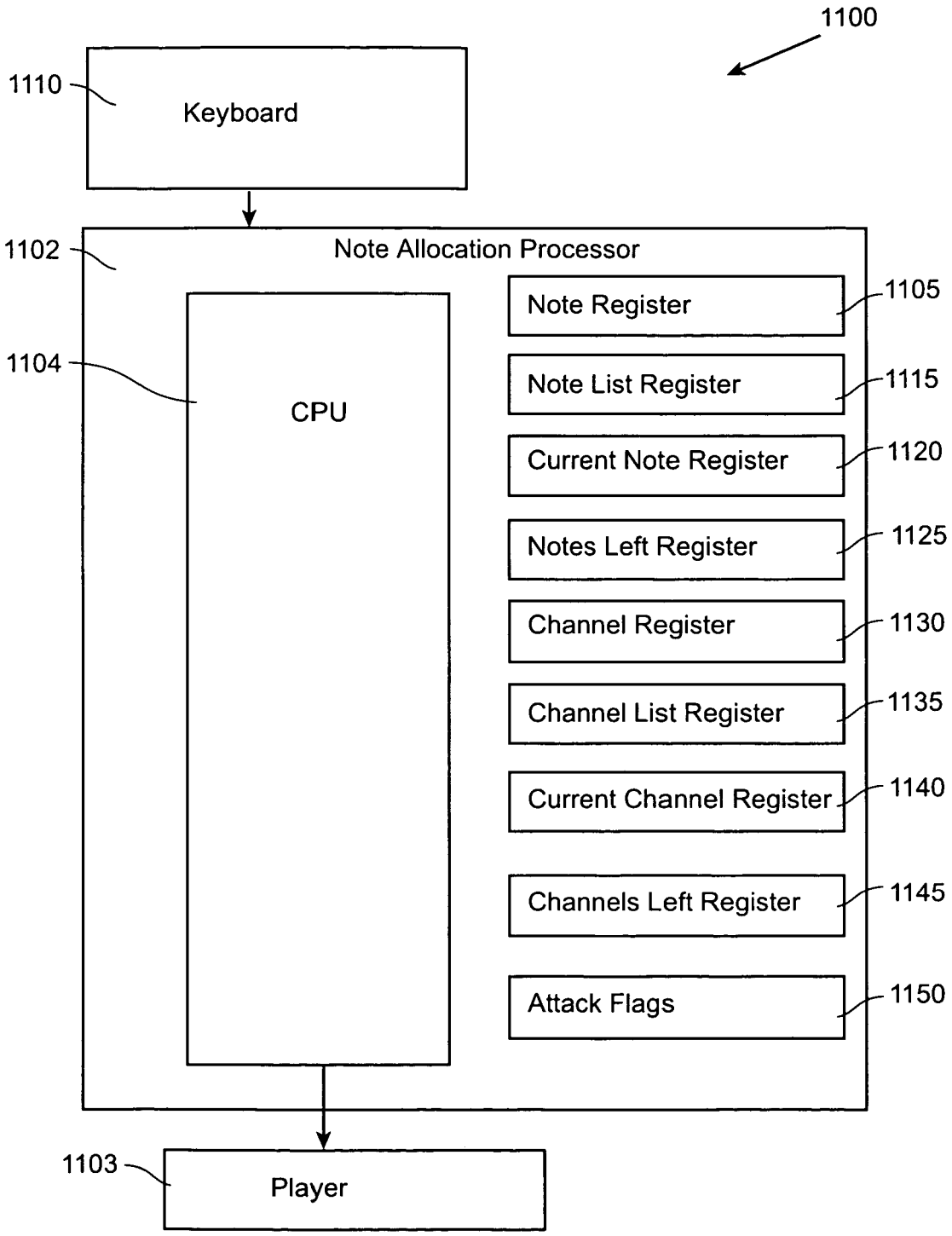

FIG. 11 is a block diagram illustrating another embodiment of a note allocation processor according to the invention.

DETAILED DESCRIPTION

The present invention departs from traditional additive polyphony and is based upon a musical concept known as "divisi." Divisi describes the way an actual orchestra would play a musical selection. If, for instance, an eight cello section of an orchestra were playing one, two or three notes at the same time, there could never be more than eight cellos playing at once. If only one note were being played, all eight would typically play that note. If two notes were being played, then perhaps four cellists would each play one note and four cellists would each play the other note. In reality, sometimes the more melodically important of the two notes would get preferential weighting; five cellists might play that note and the remaining three would play the other note. Similarly, with a triad (three notes), three cellists might play each of the two more melodically important notes, while the remaining two cellists played the third note. This is how divisi works in a real orchestra, and it is implemented there in part by the composer and/or conductor, and in part by the lead player for each section; these people determine which particular instruments sound a given note at any time. There can never be more notes being created at one time than there are instruments in that section of the orchestra (unless of course the instruments themselves are capable of playing more than one note at a time).

The invention relies upon two things to function when the system uses a sampler, (a) the original samples must be recorded for individual instruments (or sub-sets of the full section if not individual instruments), and (b) the sampler is controlled so that the number of instruments being sounded by the sampler does not exceed a predetermined number, which number in the preferred embodiment is the number of uniquely sampled sources of that instrument. (It may be possible to try to play more notes than the number of individual instruments which were originally sampled by combining additive polyphony with the present invention so that simultaneous notes played, in total, exceed the number of uniquely sampled instruments. In the event that more notes are selected to be played than the number of individually sampled instruments, combining additive polyphony to the present invention would prevent notes from being skipped while still minimizing unintended organ-like effects.)

The actual assignment of sampled sounds to notes played is done using predetermined orchestral process and/or lookup tables and/or allocation maps (referred to collectively herein as "assignment tables") which may be devised by someone with knowledge of instrumentation. The assignment tables provide instrumentation techniques which would be familiar to orchestral composers. A primary benefit of the invention in playing sampled (or synthesized) music is that it creates a much more realistic sound. The invented system may include a feature which allows for editing or adding lookup tables by the end user.

Currently most samplers and synthesizers rely upon a method of defining their parameters, and transferring control information, known as MIDI (Musical Instrument Digital Interface). While the present invention functions with MIDI systems, it can be implemented on other or future means of controlling musical instruments (e.g., MLAN from Yamaha Corporation), and in fact the invention would likely benefit from faster communications protocols available with MLAN than is possible with conventional MIDI.

For purposes of explanation, MIDI terminology will be referred to herein because that terminology is understood by those skilled in the art. Of course, the terminology is not necessarily exclusive to the MIDI environment; terms such as "ports" and "channels" can be applicable with other means of control. So, for example, in the invention one MIDI port would be used for a given section of sampled instruments (i.e., the violins) and each of the sixteen MDI channels conveyed by that MDI port can request the sounding of a single sample (e.g., one instrument, such as a violin, playing a single note).

A sampled sound library should be prepared to be suitable for use with the invention. Typically this will be with one musical instrument at a time playing each note, and stored this way in the sampler's library. (One could record two instruments at a time and save that recording as a single sample. For ease of description, we will discuss recording of individual instruments).

The sampled sound library is loaded into a suitable sampler. The means by which that library is utilized by the sampler is controlled by the present invention.

An exemplary implementation would have an end user playing a musical keyboard, which keyboard generates note commands as it is played. These commands go to a processor (hardware, firmware and/or software), which does the following: it analyzes the number of notes being played on the keyboard at any one moment and then assigns the played notes to channels of the sampler (or synthesizer), and thus ultimately to available sampled sounds. Assignment is made such that the total number of sampled instruments playing all the notes does not exceed the original number of individual instruments (or sounds) that were sampled. (As noted above, in those rare circumstances when an end user would cause more notes to be played by one orchestra section than the number of real instruments which were sampled, then additive polyphony may be used to have the sampler play the "extra" notes. Alternatively, the "extra" notes may be ignored using a predefined priority scheme favoring, for example, the most recently played notes or the highest pitched notes.) The notes are dynamically assigned in response to changes in which keys are pressed, held down, or released on the keyboard (or any other suitably-interfaced musical performance controller).

A single set of assignment tables for assignment of available sampled instruments to notes played may not be suitable for all types of music or for all types of instruments. It is expected that commercial embodiments of the invention will include a menu of assignment tables, with default settings available for various instrument sections. The choices of algorithms/lookup tables, and provision for user-commanded changes, would allow for selection of such options as top weighting (where more instruments sound the highest-pitched note) and bottom-weighting (where more instruments play the lowest pitched note).

Various embodiments of the subject invention are illustrated in the attached drawings which are referred to herein.

Figure 1:
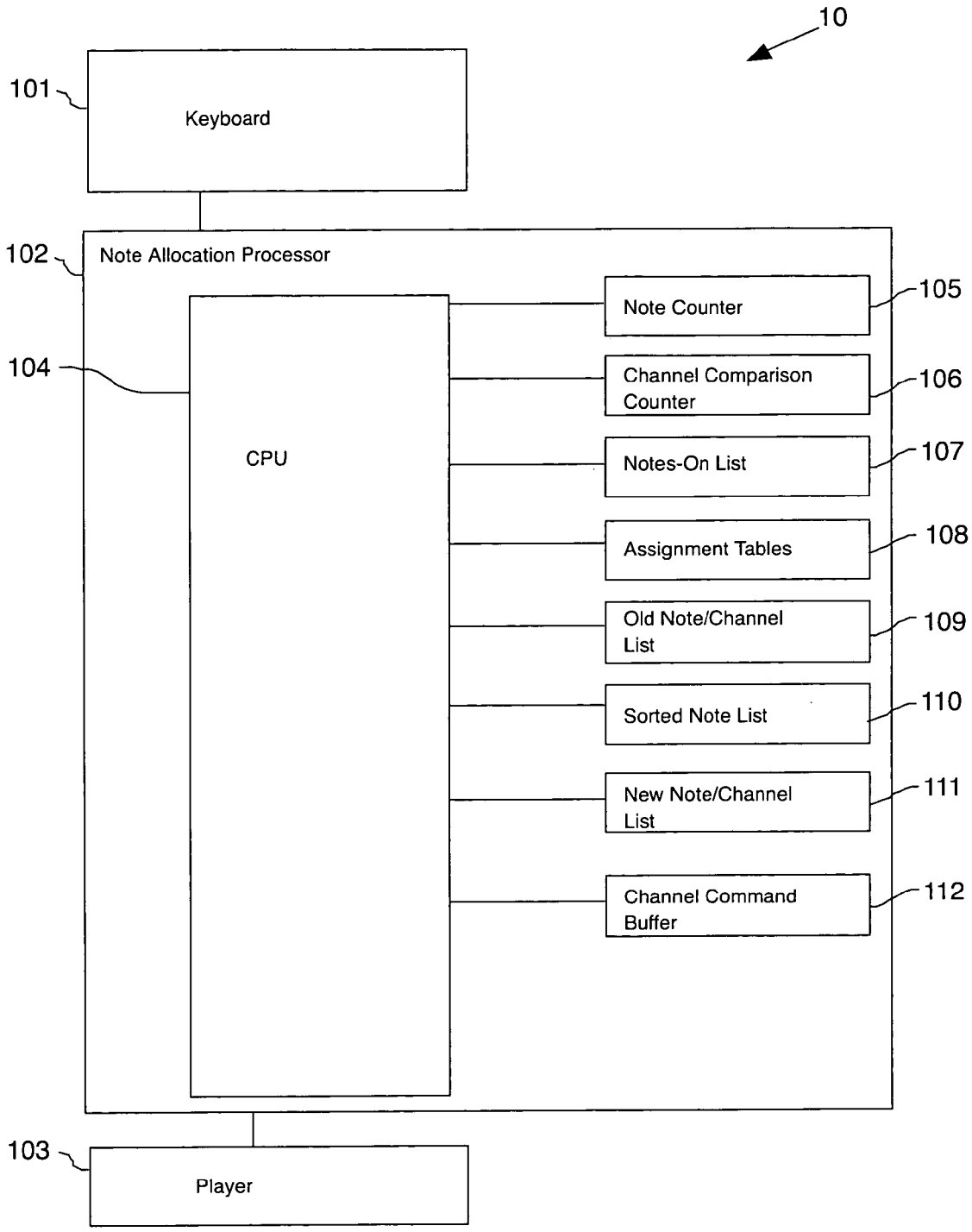

FIG. 1 illustrates an embodiment of the invention shown in a contemplated performance system 10. This embodiment includes a user input device 101, a note allocation processor 102, and a note player 103. In the embodiment described herein, the input device is a musical instrument keyboard. It may be another device as well, such as an ASCII keyboard or a MIDI controller. The note player is a MIDI sampler in the embodiment described here.

Note player 103 includes a library of recordings of notes played by individual instruments which, in the example discussed here, are comprised in an orchestra. It should be noted that the library may include other recorded sounds as well, such as sound effects, vocals, and non-orchestral instruments. For simplicity, the description herein is of a sampler loaded with recordings of individual orchestra instruments.

Note allocation processor 102 includes a central processing unit ("CPU") 104, note counter 105 and a channel comparison counter 106, and the following memory locations: notes-on list 107, assignment tables 108, old note/channel list 109, sorted notes-on list 110, new note/channel list 111 and channel commands buffer 112.

The input device, note allocation processor, MIDI interface and player work together as described below in connection with the discussion of the invented process.

The invented process, as it is most likely to be used with currently available commercial products, will rely upon various MIDI channels (which may be from one or several ports) of the player being assigned to different orchestra sections. The invention assigns notes for a given orchestra section to channels within a port such that each channel of the player will play the sample sound of a single instrument playing the noted assigned to it. It is possible to assign some channels of a particular MIDI port to one section of an orchestra and other channels of that port to another section of an orchestra. Therefore, in the discussion which follows, reference will be made to channels, regardless of ports.

An end user should perform certain setup steps. That is, the end user must first decide what section of an orchestra the input device (here a musical keyboard) will represent. Note that the end user could designate the entire keyboard for a single orchestra section (for an eight cello orchestra section or for a sixteen violin orchestra section).

Alternatively, the end user could figuratively split the keyboard into representations of two orchestra sections (e.g., the left forty-four keys of an eighty-eight key keyboard could be for a cello section and the right forty-four keys could be for a violin section). In such a case, the keyboard would be deemed to be two separate keyboards, each acting effectively separate from the other. When multiple keyboards are used, each keyboard feeds its signals to a separate note allocation processor (or note allocation processor module).

The orchestra section which a keyboard represents does not have to be a traditional orchestra section (which is usually composed of a plurality of the same instrument). The orchestra section that the keyboard represents could be defined as four violins, two cellos and two wind instruments such as oboes. The orchestra section could also be composed of other "instruments," such as a waterfall or a baby crying.

In determining what orchestra section the keyboard is representing, the end user would also determine how many instruments are in the section and the end user would then adjust the controls of the player such that a single channel of the player corresponds to each instrument.

The assignment tables loaded into the assignment tables memory location would be selected to take into account the particular composition of the section represented by the keyboard and the assignment of the player's channels.

In this regard, the user would assure that the appropriate assignment tables are loaded into the assignment tables memory location. Such assignment tables may be among a large variety of assignment tables resident in a master file located in another memory location in the note allocation processor or in an associated computer and selected therefrom by the end user for loading into the assignment tables memory location, or the assignment tables may be specially written by the end user and loaded into the assignment tables memory location.

The end user would also assure that appropriate samples are located in the player's sample library (if it is a sampler) or that the player has the capability to produce the desired sounds (if the player is a synthesizer).

The term "note" traditionally means a tone of a particular frequency. (For example, the frequency of the note A above middle C on a piano is 440-443 Hz depending upon what standard or scale is used.) For purposes of this disclosure, the term "note" includes any sound which may be produced (e.g., a waterfall or baby crying) as well as sounds made by traditional orchestra instruments.

Figure 2A:
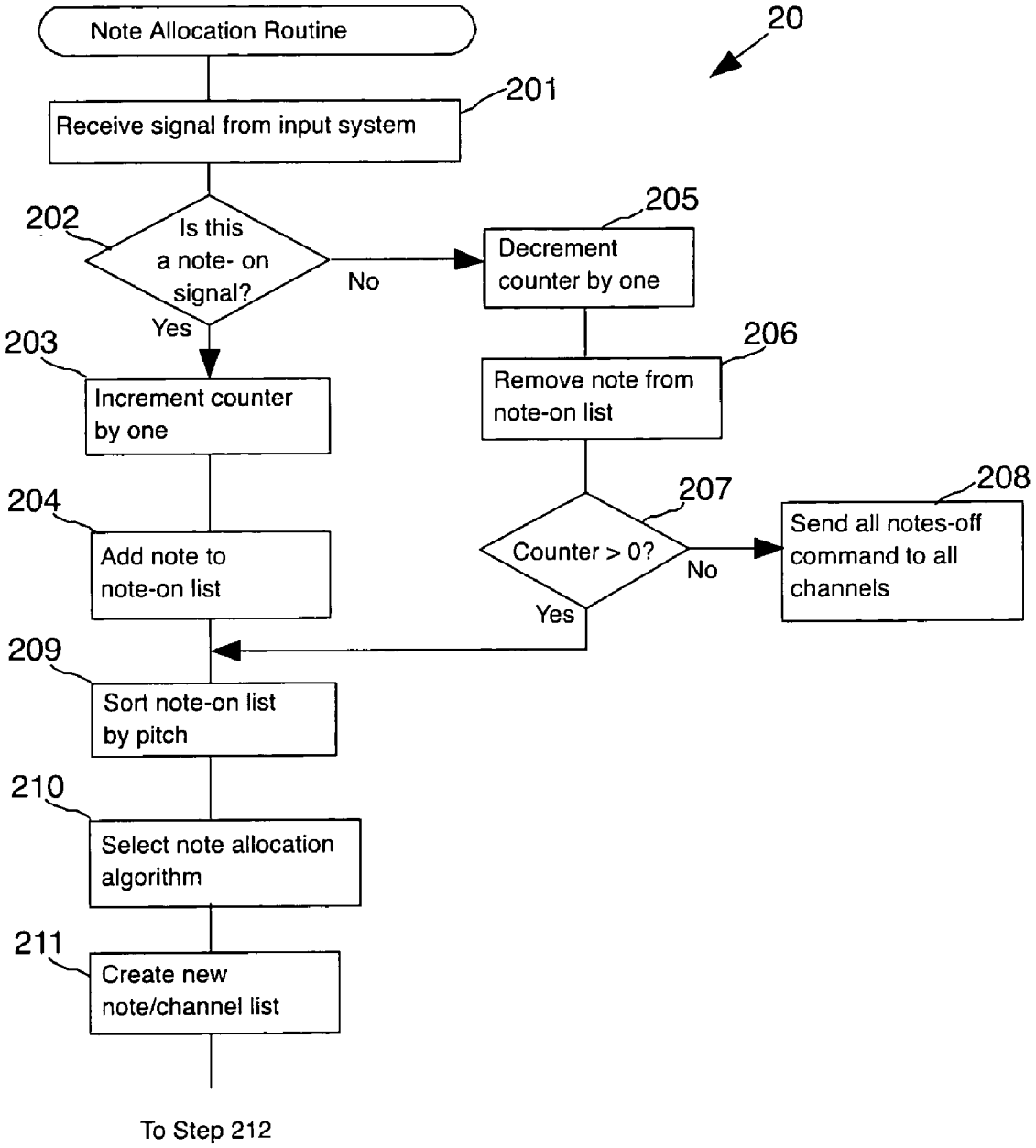
Figure 2B:
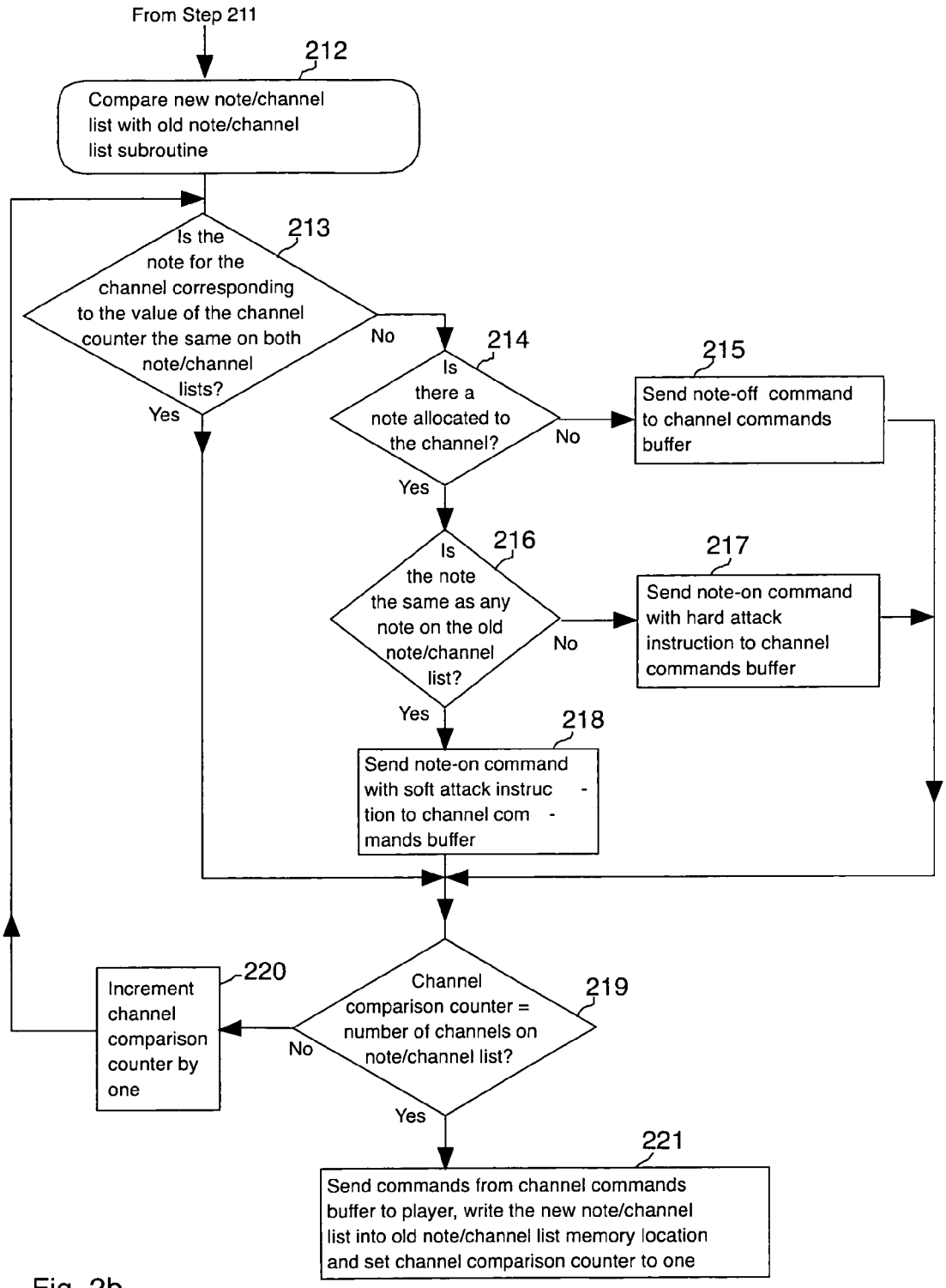

The dynamic note allocation process 20 is illustrated in FIGS. 2*a* and 2*b*. A signal from keyboard 101, indicating a new event (i.e., a change in what the end user desires to be played) is received by the CPU 104 of note allocation processor 102 in step 201. (User input devices may also provide other instructions besides which notes should be played. For purposes of the discussion herein, these other instructions are deemed to be passed through the note allocation processor.) Even if the end user's hand comes down on, or off of, multiple keys, the actual communication from the keyboard of changes in the notes being played is serial (one after another, albeit in possibly very rapid and randomly-ordered sequence). After receiving the new event signal, the CPU then performs step 202, wherein the CPU determines whether or not the event contains a note-on instruction (e.g., the result of the end user's pressing down of a key on the keyboard). If the answer is "yes" (i.e., it is a note-on instruction), then the CPU performs step 203, which is incrementing the note counter 105 by one. (When the note allocation processing is first begun, the note counter is set to zero.) Then the CPU performs step 204 in which it adds the note which is being turned on to the notes-on list in notes-on list memory location 107. If the answer to the query of step 202 is "no" (i.e., in which case the event must be the cessation of the playing of a note and the incoming signal is interpreted as a note-off instruction), the CPU performs step 205 in which it decrements the counter by one. The CPU then performs step 206 in which it removes the note which is being turned off from the notes-on list in memory location 107.

If as a result of a note-off instruction, there are no notes to be played, there is no longer any need for note allocation. In this regard, the CPU performs step 207 in which it determines whether the note counter has a value greater than zero. The counter represents the number of notes being played at any one time (or the number of notes listed in the notes-on list). If the answer is "no," then the CPU performs step 208, in which the CPU causes the note allocation processor to send either (i) an all notes off command to the player with respect to all channels corresponding to the keyboard or (ii) individual note-off commands to the player fore each channel currently sounding a note. In addition, in step 208 the CPU sets the channel comparison counter to one and sets the contents of the old note/channel list memory location to null. In an alternative embodiment, step 207 could be a determination of whether there is at least one note on the notes-on list. Again, if the answer is "no," the CPU performs step 208. The all notes-off command also assures that no unintended notes are sounded by the player 103.

If the answer to the query of step 207 is "yes," or if the answer to the query of step 202 is "yes" and step 204 has been performed, the CPU performs step 209.

As noted above, the issuance of the all notes off command (or the individual note-off commands) in step 208 is a fail safe feature. This feature may be deemed to be unnecessary. In which case, steps 207 and 208 would be eliminated and the process would proceed to step 209 from step 204 or step 206.

In step 209 the CPU sorts all notes currently being played (i.e. the notes on the notes-on list in notes-on list memory location 107) according to their pitch and stores the sorted notes list in sorted notes list memory location 110. The sorting may instead be done concurrently with the addition or removal of a note from the notes-on list in steps 204 and 206, respectively, and the notes-on list in memory location 107 then serves as the sorted note list.

For the sake of simplicity in this explanation, the input device is considered to be playing only up to as many notes as there are channels (and, correspondingly, instruments) for the section of the orchestra represented by the keyboard. The invention could be configured to accommodate the playing of additional notes by, after step 209, determining how many notes are on the sorted notes-on list and, to the extent that the number of notes exceeds the number of channels that correspond to the keyboard, that number of the lowest notes (in a top weighted system) are removed from the sorted notes-on list and read into the sorted notes-on list of a supplemental note allocation processor which addresses the same channels of the player so that they play multiple notes polyphonically, and skipping of notes is avoided. The supplemental note allocation processor then would assign only one channel to each note, with the lowest pitch note assigned to highest-numbered channel and so forth (i.e., in an eight channel setup, the lowest pitched note would be assigned to the eighth channel and the next lowest pitched note would be assigned to the seventh channel). Alternatively, the invention may work so as to skip the "additional" or "extra" notes pursuant to a priority scheme, as noted above.

After step 209 the CPU then performs step 210. In that step the CPU consults the assignment tables in assignment tables memory location 108 for the appropriate note allocation assignments for the number of notes to be played. Then the CPU performs step 211, wherein the CPU, pursuant to the note allocation assignments received in step 210, prepares a new note/channel list which it stores in new note/channel list memory location 111. Pursuant to this list, a channel is correlated to a note in accordance with the note allocation assignments. As discussed further below, each channel of the player corresponding to the keyboard receives either (i) no command to play a sample or (ii) a command to play a sample of a particular note.

By way of example, when a note is removed from a previously played group of notes (i.e., the end user's finger is released from a group of notes which had been held by the end user), channels which previously were assigned to the released note are reassigned to the notes still being played. For playing an eight cello section, assignment tables for eight cellos, such as assignment tables 301-308 shown in FIG. 3, would have been loaded into assignment tables memory location 108. If three notes had been played and these had been sounded by eight instruments (e.g., eight separate samples of one cello each), the note allocation processor, with a top weighted assignment table for three notes (e.g., table 303), would have assigned three channels to the highest note, three channels to the middle note and two channels to the lowest note. If the highest note is released by the end user, then the channels which had been assigned to that note must be reassigned to the remaining two notes in order to preserve the orchestral balance. The steps described up to now accomplish this.

In this regard, if the system shown in FIG. 1 were being used for allocating notes among the cellos of an eight cello orchestra section, and if at a particular time three notes were being played, namely C, E and G, with G having the highest pitch and C the lowest, the old note/channel list in memory location 109 would have three channels (e.g. first, second a third cello channels) each assigned note G, three channels (e.g., fourth, fifth and sixth cello channels) each assigned note E, and two channels (e.g. seventh and eighth cello channels) each assigned note C. If the new event is the end user lifting his finger from the G key, the keyboard sends a G note-off signal to the note allocation processor, which receives the new event signal in step 201. In step 202 the CPU determines that this new event is not a note-on signal and proceeds to step 205. The CPU decrements the note counter from three to two. In step 206 the CPU removes G from the notes-on list in memory location 107. The CPU then performs step 207 in which it determines that the value in the counter is in fact greater than zero, and moves to step 209.

In step 209 the CPU sorts the notes in the notes-on list by pitch into a sorted notes-on list. The CPU stores the sorted notes-on list of two notes, E and C (sorted from highest to lowest pitch) in memory location 110.

The CPU next performs step 210. In performing this step, the CPU (i) interrogates either the counter or the notes-on list or the sorted notes-on list to determine how many notes are being played concurrently, and (ii) selects the assignment table which corresponds to that number of notes. Here assignment table 302, for two notes in a cello section, is selected.

Then the CPU performs step 211. For the example discussed here, the predetermined assignment table 302, for two notes played by an eight cello orchestra section provides for four channels playing the higher note and four channels playing the lower note. So, pursuant to this allocation, the CPU in Step 211 consults the sorted notes-on list in memory location 110 and assigns the first through fourth cello channels to play the higher note (here note E), and the fifth through eighth cello channels to play the lower note (here note C). In this step the CPU also creates a new note/channel list which reflects these new channel assignments and stores the new note/channel list in new note/channel list memory location 111.

If the player were of an idealized embodiment, the CPU would now perform a step of causing the note allocation processor to send a set of commands corresponding to each of the note allocations set forth on the new note/channel list to the input of player 103, and player 103 would respond by having each of its respective channels which correspond to the keyboard play the prerecorded sample corresponding to the note assigned to that channel.

However, currently available players are configured so that their respective channels continue playing notes which they have been commanded to play until a note-off signal is received. That is, current players are polyphonic and, for example, once a particular channel has been commanded to play a cello sounding note C, that channel would continue playing the sample of the cello sounding note C even after that channel receives a command to play a cello sounding note E. Such channel would be playing two notes (i.e., playing two samples, one of a cello sounding note C and the other of a cello sounding note E) after receiving the second signal. The present invention takes the configuration of current players into account.

Here a brief explanation of musical terms "hard attack" and "soft attack" would be helpful. The concept of a hard attack or a soft attack is not new in electronic music. The method in which such attacks are invoked as a response to continuing or reassigned notes, as described herein, is new.

In general, a sound (a sampled note in this case) which begins abruptly or with a steep increase in amplitude (i.e., a sudden onset of sound) is said to have a hard-attack. Examples would be such sounds as the plucked beginning of a guitar note, or the hammered-down beginning of a piano note. A sound which commences with a gradual increase in amplitude is said to have a soft attack. Examples would be such sounds as a gently applied bow to a violin string or a softly blown flute note. Hard attack and soft attack are terms familiar to the music business. Many traditional samplers (and synthesizers) allow for control of the attack characteristic, by means of shaping the amplitude envelope of the onset of any given sound. It is also possible to assign control parameters that select attack characteristics.

In the case of the note allocation process described herein, the concern is not with the hard or soft attack nature of the sampled sound. The concern is this: does a given new event comprise a newly-played note (i.e., a note which is not being played on any of the channels of the player (and is therefore not listed in the old note/channel list). If it is, then the player should be commanded to play that newly-played note on the channels assigned that note as a hard attack sound.

However, if the new event comprises the cessation of the playing of a particular note while other note(s) are still being held, then the assignment of notes to channels would essentially be a re-assignment of the released channels to held notes, and a hard attack would be inappropriate. Similarly, even when the new event comprises the addition of a newly-played note to one or more other notes which continue to be sounded (i.e., held), there is likely to be a reassignment of the held notes among the channels. With respect to a channel playing a held note (regardless of whether that channel was that channel which had been playing the note before the new event), a soft attack is required so that the held note does not sound as if it were a freshly-played note. That is, reassigned notes should not sound like new notes being played; they must smoothly appear without drawing attention to themselves.

So after step 211 the CPU performs the compare new note/channel list with old note/channel list subroutine 212, in which the CPU compares the new note/channel list in memory location 111 to the old note/channel list that is stored in memory location 109, on a channel-by-channel basis.

For each channel, one of four possibilities exists:

(i) it is going to continue playing the same note which it is currently playing (i.e., the channel will be playing the same note that it was playing before the new event), in which case the CPU causes no signal to be sent to the player with respect to that channel because, as mentioned above, current players have each of their channels continue to play whatever sample they are playing until a note-off command is received by the player;

(ii) it is going to play a note which is not currently being played by any channel on the note/channel list (i.e., the note is not listed on the old note/channel list), in which event the CPU causes two commands to be sent to the player with respect to that channel, first a note-off command with respect to the note currently being played by that channel and second a note-on command with respect to the new note for that channel, which note-on command is accompanied by a hard-attack instruction;

(iii) it is going to play a note that is new to that channel but was being played by at least one other channel before the new event under discussion (i.e., the note is listed on the old note/channel list), in which case the CPU causes two commands to be sent to the player with respect to that channel, first a note-off command with respect to the note currently being played and second a note-on command with respect to the new note for that channel, which note-on command is accompanied by a soft-attack instruction;

(iv) no note is to be played by the channel, in which case the CPU causes a note-off command to be sent to the player with respect to that channel.

So, in subroutine 212, the CPU performs step 213 with respect to each channel. In this step the CPU queries whether the channel is to be playing the same note as it was playing before the new event. If the answer is "yes," then no signal is sent to that channel. If the answer is "no," then the CPU performs step 214 in which the new note/channel list is queried to see if any note is to be played by that channel.

If the answer is "no," then step 215 is performed, in which the CPU sends a note-off command to the channel commands buffer in memory location 112 with respect to the note which is currently being played by that channel.

If the answer to the query in step 214 is "yes," then step 216 tests to see if the new note on that channel is the same as any notes on the old note/channel list. If the answer is "no," step 217 is performed in which the CPU sends to the channel commands buffer in memory location 112, with respect to that channel, a note-off command with respect to the note that is currently being played on the channel (as listed on the old note/channel list) and a new note-on command, which note-on command includes the identity of the note on the new note/channel list corresponding to the channel being compared, along with a hard attack instruction.

If the answer to the query of step 216 is "yes," step 218 is performed in which in the CPU sends to the channel commands buffer with respect to that channel a note-off command with respect to the note that is currently being played on the channel (as listed on the old note/channel list) and a new note-on command, which note-on command includes the identity of the note on the new note/channel list corresponding to the channel being compared, along with a soft attack instruction.

Alternatively, step 216 could instead test to see if the answer to the query of step 202 is "yes" (or if the new event is a note-on signal). If, with respect to this alternate version of step 216, the answer is "yes," then step 217 is performed as described above, and if the answer is "no," then step 218 is performed as described above.

After each of steps 213, 215, 217 and 218, the CPU performs step 219 in which the CPU determines whether the value of the channel comparison counter is equal to the number of channels on the new note/channel list. (The number of channels on the new note/channel list is the same as the number of instruments in the orchestra section which is being played.) If the answer to the query of step 219 is "no," this means that the comparison of the new note/channel list with the old note/channel list has not been completed with respect to every channel. In which case, the CPU performs step 220 in which the channel comparison counter is incremented by one. Then the CPU returns to step 213 and repeats the portion of the process beginning with that step until the comparison is completed with respect to all of the channels.

If the answer to the query of step 219 is "yes," this means that the comparison of the new note/channel list with the old note/channel list has been completed with respect to every channel. In which case, the CPU performs step 221 in which the CPU (i) causes the note allocation processor to send the commands in the channel commands buffer to the player's input, (ii) writes the new note channel list into the old note/channel list memory location 109 (i.e., the new note/channel list becomes the old note/channel list for the next event), and (iii) sets the channel comparison counter to one.

The setting of the channel comparison counter to one could instead be done as part of step 201 or step 211 any other time prior to entering the compare new note/channel list with old note/channel list subroutine.

In addition, the contents of the channel commands buffer should be erased as part of step 201 or step 211 any other time prior to entering the compare new note/channel list with old note/channel list subroutine.

The system and process described above provides a test for each channel to see if it is playing a held note (i.e., any note appearing on the old note/channel list) and if so, the corresponding channel in the player is commanded to play the note with a soft attack. (If the channel were already playing the same note, then no command need be sent to the player with respect to that channel and that channel would continue to play the same note.) If it is not a held note, then it is a newly-played note, and, as noted above, step 217 provides that the note-on command for that note will include a hard attack instruction. (It has earlier been mentioned that with respect to the playing of a new note, the keyboard may have included additional instructions which are passed through the note allocation processor. Such instructions may override the hard attack instruction provided by step 217.)

Returning now to the discussion of the example of assigning notes to the channels of a system emulating an eight cello orchestra section (in which the CPU performed step 211 by assigning note E to the first through fourth cello channels, and note C to the fifth through eighth cello channels and creating a new note/channel list reflecting these channel assignments and storing the new note/channel list in new note/channel list memory location 113), the CPU next performs step 212. This is the Compare New Note/Channel List with Old Note Channel List Subroutine described above.

The old note/channel list (in memory location 109) and new note channel list (in memory location 111) are as follows:

| Old Note/Channel List | New Note/Channel List |
|---|---|
| Channel No. 1: G | Channel No. 1: E |
| Channel No. 2: G | Channel No. 2: E |
| Channel No. 3: G | Channel No. 3: E |
| Channel No. 4: E | Channel No. 4: E |
| Channel No. 5: E | Channel No. 5: C |
| Channel No. 6: E | Channel No. 6: C |
| Channel No. 7: C | Channel No. 7: C |
| Channel No. 8: C | Channel No. 8: C |

In performing the Compare New Note/Channel List with Old Note Channel List Subroutine, the CPU performs step 213 in which the CPU checks the value of the channel comparison counter and compares the note on the new note/channel list for the channel corresponding to that value with the note on the old note/channel list for same. Since this is the first time that step 213 is being performed since the new event, the value of that counter is one. So, the CPU compares the channel 1 assignments of the old and new note/channel lists. Here the answer to the query of step 213 is "no" (i.e., the notes for channel 1 are not the same for both lists). The CPU then performs step 214 to assure that channel no. 1 does have a note assigned to it pursuant to the new note/channel list. The answer to this query is "yes" and the CPU performs step 216 in which it determines whether the note assigned to channel no. 1 on the new note/channel list is the same as any note on the old note/channel list. The answer to this query is "yes" because, even though note E is "new" to channel no. 1, note E was assigned to at least one channel pursuant to the old note/channel list. The CPU then, pursuant to step 218, sends to the channel commands buffer in memory location 114 with respect to channel 1 a note-off command (i.e., that note G should not be played) and a note-on command (i.e., commanding that channel 1 play note E), which note-on command is accompanied by a soft attack instruction. The CPU then performs step 219, in which the answer to the query of that step is "no" because the number of channels on the new note channel list is eight while the value of the channel comparison counter is only one. The CPU then performs step 220 in which it increments the channel comparison counter by one (i.e., to a value of two).

So, the CPU returns to step 213 in which it performs as described in the paragraph above, this time with respect to channel no. 2. Since channel no. 2 on the new note/channel list is compared to channel no. 2 of the old note/channel list, the results for channel no. 2 are the same as for channel no. 1, except this time when the channel comparison counter is incremented by one in step 219, its value becomes three.

The CPU returns to step 213 in which it performs as described in the paragraph above, this time with respect to channel no. 3. The result is the same as with channels nos. 1 and 2, except this time when the channel comparison counter is incremented by one in step 220, its value becomes four.

The CPU returns to step 213, this time to check if the note assigned to channel no. 4 on the new note/channel list is the same as the note assigned to channel no. 4 on the old note/channel list. Now the answer is "yes" (note E is the note assigned to channel no. 4 on both note/channel lists). Therefore, the CPU proceeds directly to step 219 (i.e., no command with respect to channel no. 4 need be sent to the channel commands buffer). The answer to the query of step 219 is "no" because the number of channels on the new note channel list is eight while the value of the channel comparison counter is four. The CPU then performs step 220 in which it increments the channel comparison counter by one (i.e., to a value of five).

Again the CPU returns to step 213, this time to check if the note assigned to channel no. 5 on the new note/channel list is the same as the note assigned to channel no. 5 on the old note/channel list. The answer is "no," and the CPU performs as described above for channels nos. 1, 2 and 3, except that, pursuant to step 218, the CPU sends note-off command for the note E and a note-on command for playing note C, and, pursuant to step 220, the channel comparison counter is incremented from five to six.

The CPU returns to step 213 in which it performs as described in the paragraph above, this time with respect to channel no. 6. The result is the same as with channel no. 5, except this time when the channel comparison counter is incremented by one in step 220, its value becomes seven.

Once again the CPU returns to step 213, this time to check if the note assigned to channel no. 7 on the new note/channel list is the same as the note assigned to channel no. 7 on the old note/channel list. Because the answer is "yes," the CPU performs as described above in connection with channel no. 4, except that when the CPU performs step 220, it increments the channel comparison counter to eight.

The CPU returns to step 213, this time to check if the note assigned to channel no. 8 on the new note/channel list is the same as the note assigned to channel no. 8 on the old note/channel list. Because the answer is "yes," the CPU performs as described above in connection with channels nos. 4 and 7, except that when the CPU performs step 219, the answer to the query is "yes" (i.e., both (i) the number of channels on the new note channel list and (ii) the value of the channel comparison counter are eight). Instead of performing step 220 after step 219, the CPU performs step 221 in which it (i) causes the note allocation processor to send channel commands from the channel commands buffer to the player (namely, for channel 1, a G note-off command and an E note-on command with soft attack instruction; for channel no. 2, a G note-off command and an E note-on command with soft attack instruction; for channel no. 3, a G note-off command and an E note-on command with soft attack instruction; for channel no. 4, no command (i.e., the player's channel no. 4 will keep playing whatever note it is already playing); for channel no. 5, an E note-off command and an C note-on command with soft attack instruction; for channel no. 6, an E note-off command and an C note-on command with soft attack instruction; for channel no. 7, no command; and for channel no. 8, no command); (ii) writes the new note/channel list into old note/channel list memory location 109 (and erasing what was there before), and (iii) sets the channel comparison counter to one.

At this point the note allocation processor has completed the note allocation process for the event and is ready to process the next event which comes along.

In a contemplated embodiment, the player would be a sampler with each channel of the sampler having a specific library associated with it. For example, for the playing of an eight cello orchestra section, the library for channel no. 1 would include recordings of a first chair cellist playing a set of notes; the library for channel no. 2 would include recordings of a second chair cellist, and so on. With such special libraries, a real orchestra could be even more closely emulated. In this regard, assignment tables could have additional impact, with the most important notes being played by the recordings of the most skilled musicians.

The note allocation processor and player, or the input device, note allocation processor and player, may be manufactured as an integrated whole product. The description set forth above would still apply.

The note allocation processor may be used in connection with live performances or in connection with recording music in studio sessions. In addition, each set of commands which are sent to the channel commands buffer may be recorded automatically and reproduced as music charts or musical scores for orchestration, or for generating stored note-playing data for subsequent generation of synthesized sound or orchestration.

As noted above, various embodiments of the invention may utilize an various processes to perform various functions and features of the invention. The processes may be implemented using software, hardware, or a combination thereof which can be operated in a general purpose or a specifically tailored computer. The process may also be incorporated into a musical instrument, such as a digital sampler, a synthesizer, etc. One example is the use of a divisi process in a computer or a musical composing instrument. The core divisi process is Subtractive Divisi, in which multiple instruments (or multiple clusters of instruments) are divided to play, respectively, two or more notes that are sounding at once. We generally use the terms "path" or "divisi path" herein rather than "instrument" because it is less restrictive; any sound, whether made by or emulating a musical instrument or some other source can be assigned to a "path," and a given path may represent a single instrument or multiple instruments. So a "path" is a way to address a stored sound, and typically it's synonymous with a MIDI channel, though any functional addressing scheme can be used in conjunction with a path. Because the exemplary processs are devised to work in a MIDI environment and were so tested, we sometime use the term "channel" rather than "path" and in this context "channel" refers to a MIDI channel.

When only a single note is sounding, technically there is no divisi occurring because all instruments are playing that one note, although this situation is nonetheless accommodated by the methods presented herein so that there is a unified way to handle any number of notes being sounded. Top Weighting and Bottom Weighting are choices one sets for a given instance of divisi, wherein a non-evenly divided set of instruments (paths) are addressed to yield more sound power (more paths) on the higher notes (top weighted) or on the lower notes (bottom weighted). Typically Bottom Weighting is used on lower pitched instruments such as celli or tubas, whereas Top Weighting is used on higher pitched instruments such as violins or trumpets.

The authors have used the C++ computer language to implement the various divisi processes discussed herein, but any suitable computer language, or indeed even analog devices or dedicated digital circuits could be used to implement the essence of the methods described. There are varying degrees of abstraction in such an implementation, and for this reason we present flow charts that explain the basic steps involved; these should not be considered to be restrictive or definitive but they should give a technician or programmer skilled in the art enough information to create a functioning implementation of the divisi methods described.

Different procedures are required in order to allocate channels to notes whenever there are more notes being played than the number of paths available to play them (i.e., where there is "overflow" or "note overflow"); these procedures are described after the basic procedures wherein the number of notes being played is equal to or less than the number of paths available to play them (i.e., where there is no overflow).

Figure 4A:
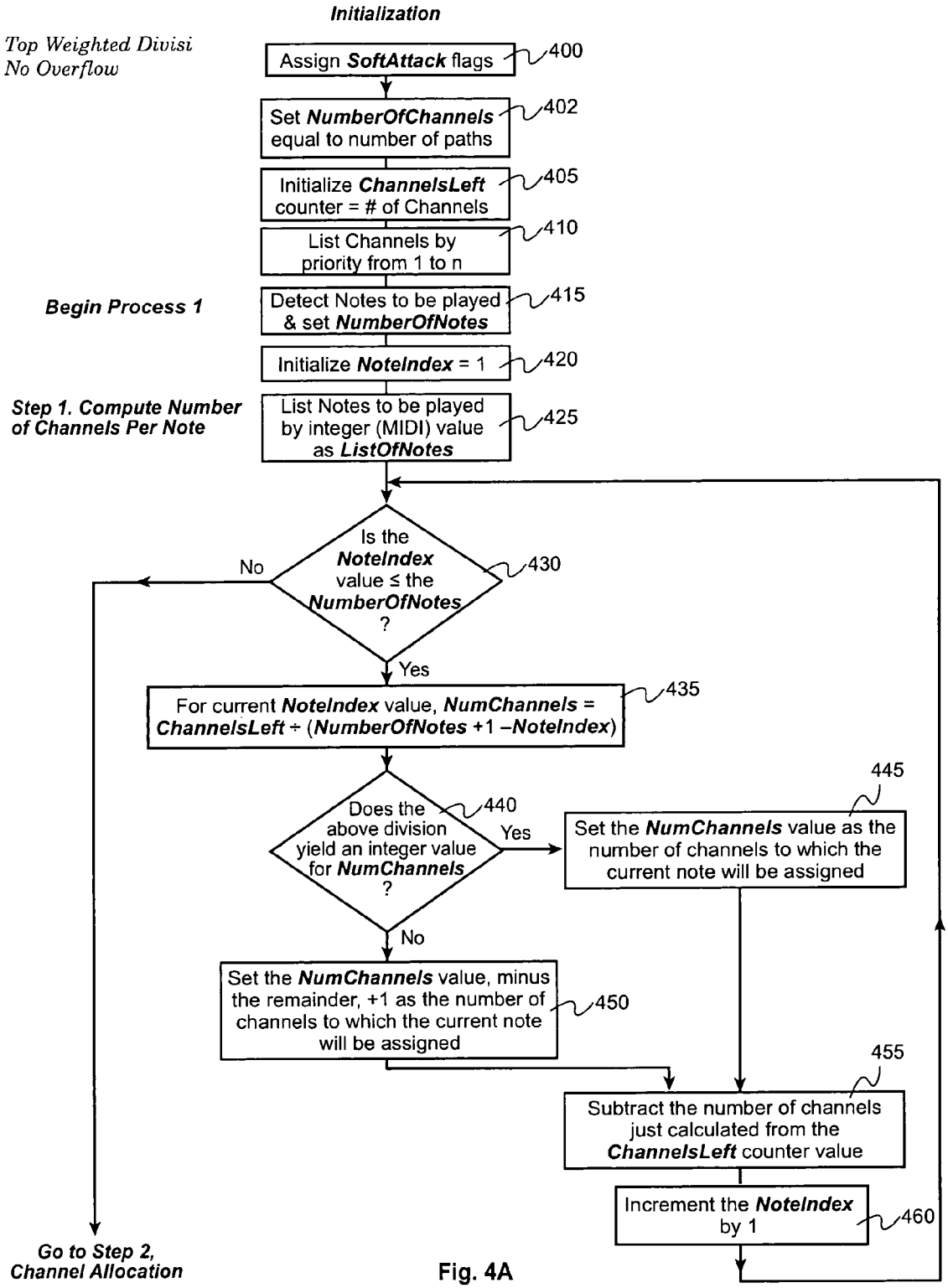
FIG. 4A is a flow chart for a process of the first step in the method for accomplishing top-weighted subtractive divisi when there are no more notes than the number of channels (i.e., when no note overflow condition exists).

FIG. 4A is the first of two illustrations of how Top Weighted Divisi may be implemented using software, hardware, or a combination thereof. In 400 through 410 an optional soft attack flag is set, and some values are initialized to establish the number of available channels (paths) and their priority. This first process begins in 415 as the system accepts an input from some source of notes, and identifies the number of notes present. A looping index is initialized to a value of 1 (starting point, first note) in 420. Step 1 of this process computes the number of channels (paths) to be allocated to each note, beginning at 425 where the notes to be played are listed according to their MIDI values, which automatically sorts them from highest pitch (high MIDI number) to lowest pitch (low MIDI number). Test 430 checks to see if all the notes have yet been processed, and a "yes" result indicates there are still more notes to process. So in 435, 440, 445 and 450 a value is derived for how many channels will be allocated to the present note, looking at how many channels have yet to be allocated and how many notes have yet to be processed. The counters and indexes are updated in 455 and 460, and again a test is made at 430 to see if any notes remain to be processed. If not a "no" is returned and the process moves on to Step 2.

Figure 4B:
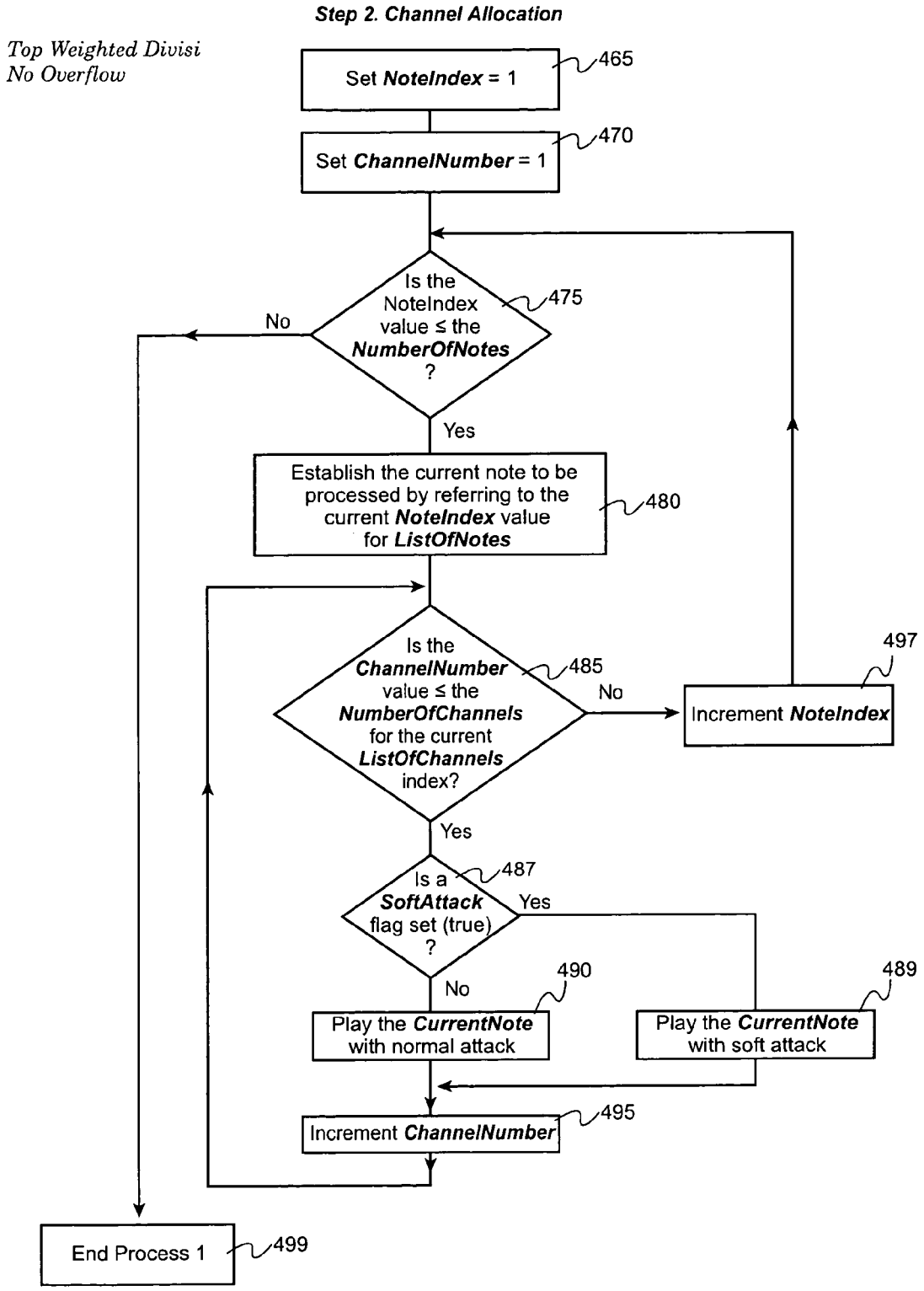
FIG. 4B is a flow chart for a process of the second step in the method for accomplishing top-weighted subtractive divisi when there are no more notes than the number of paths (i.e., when no note overflow condition exists).

In Step 1 the number of channels per note were determined, but not the specific channels or specific notes to be associated with one another. In FIG. 4B, Step 2 depicts the means by which the available channels are now specifically allocated to specific notes in the list of notes to be played. Initializing a note index to 1 at 465, and beginning with channel 1 at 470, a test is made in 475 to see if there are any more notes to which channels must be assigned. If there are (yes) then the current note is fetched from the list of notes in 480 and a test is made to determine if the note has yet been played by all channels which are supposed to play it per 485. If it's not (yes) there is a test to determine whether the note to be played should have a soft attack 487, and if the soft attack flag is set true then the current channel plays that note with a soft attack instruction 489. If test 487 shows a soft attack flag is not set, then the current channel plays that note with a normal attack instruction (490), the channel index is incremented (495), and the test of 485 is repeated. This process continues until the number of channels that are supposed to play the note have played it, at which point 485 returns a No, the note index increments in 497, and again test 475 is performed to see if any notes remain to be so processed (i.e., to see if any notes have yet to be played by remaining channels). If there are not more notes, 475 returns a No and the process is completed per 499. At this point, divisi has been applied to all notes such that all channels have been assigned and played.

Figure 4C:
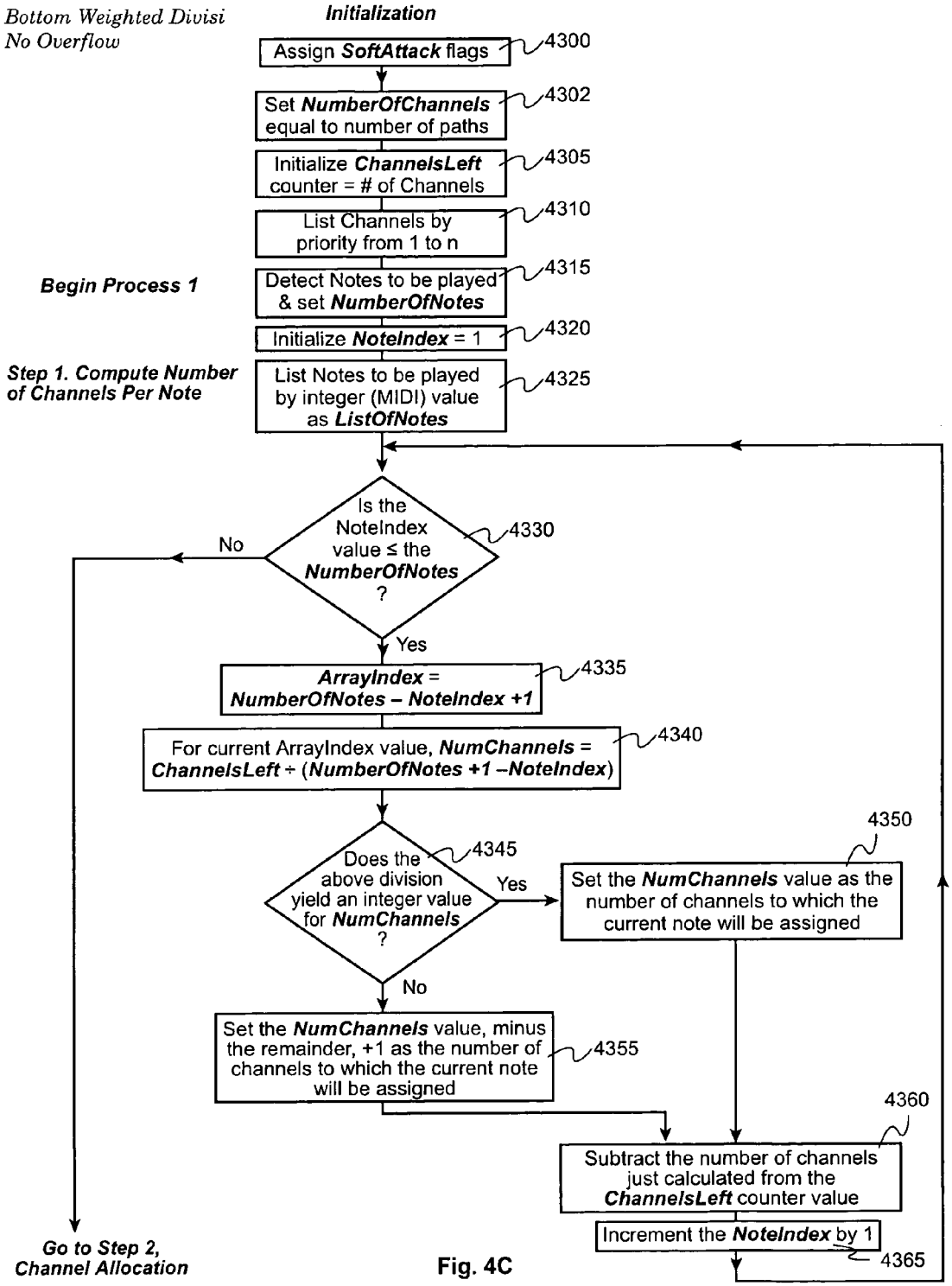
FIG. 4C is a flow chart for a process of the first step in the method for accomplishing bottom-weighted subtractive divisi when there are no more notes than the number of paths (i.e., when no note overflow condition exists).

FIG. 4C is the first of two illustrations of how Bottom Weighted Divisi may be implemented. It is somewhat similar to FIG. 4A for Top Weighted Divisi. The first difference occurs right after test 4330 (similar to test 430 in FIG. 4A) where the function 435 from FIG. 4A is gone and instead we gain the functions 4335 and 4340 of FIG. 4C in which an array index is set and a channel list is made which essentially builds in reverse order compared to the additive divisi process. Other than that, the calculation of channels per note in 4335 through 4355 of FIG. 4C is pretty much like than in 435 through 450 of FIG. 4A.

Figure 4D:
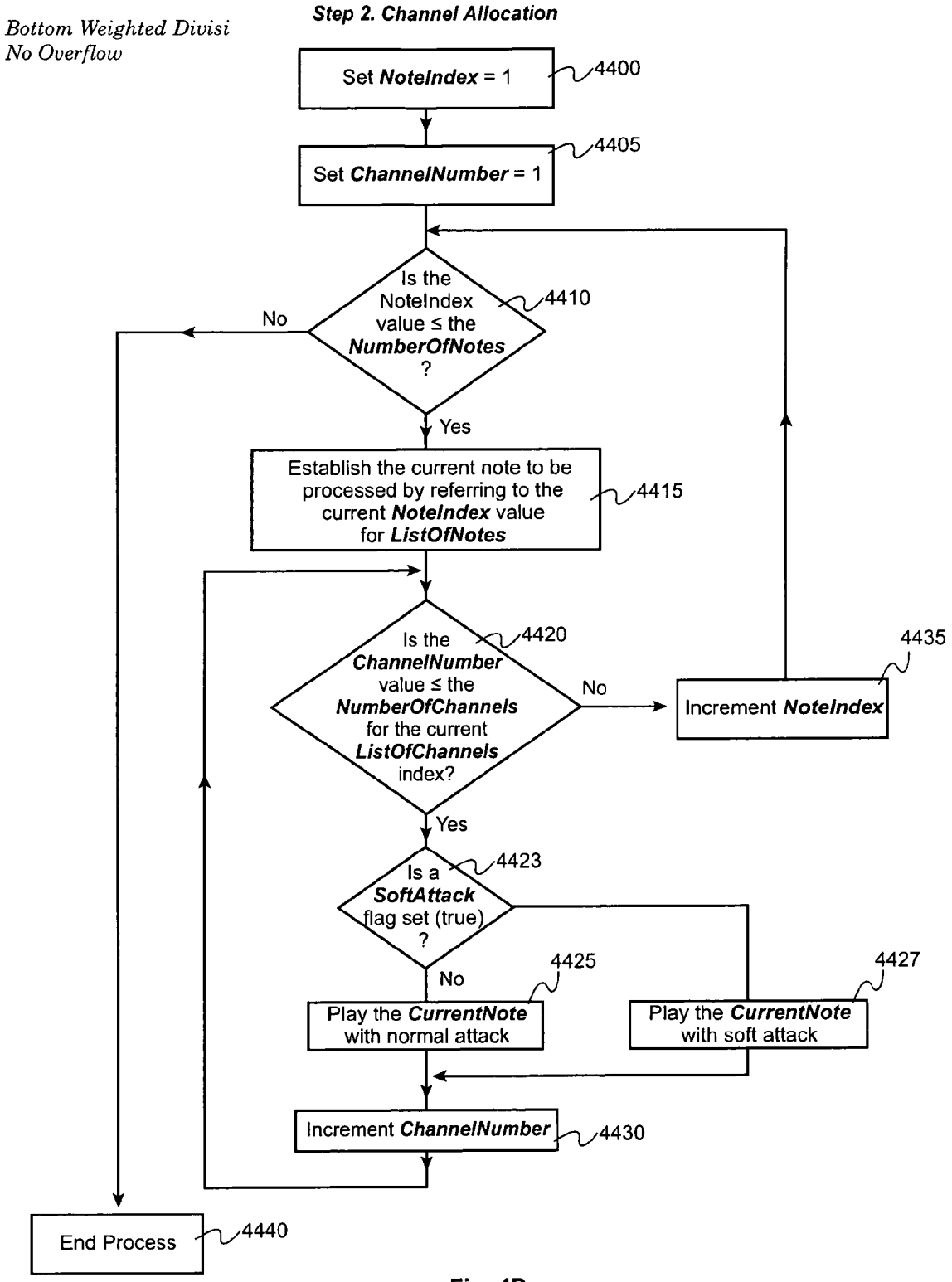
FIG. 4D is a flow chart for a process of the second step in the method for accomplishing bottom-weighted subtractive divisi when there are no more notes than the number of paths (i.e., when no note overflow condition exists).

In Step 1 of FIG. 4C the number of channels per note were determined, but not the specific channels or specific notes to be associated with one another. So this process now occurs in Step 2, as shown in FIG. 4D, which is essentially identical to the process of FIG. 4B, Step 2. The only difference is that because the list of channels per note was built "upside down" in FIG. 4C relative to FIG. 4A such that the greater number of paths is assigned to lower MIDI number (lower pitch) notes, the actual channel to note allocation winds up as a bottom weighted allocation, assuming there is a non-even division of channels to notes. It should be appreciated that when the number of channels is evenly divisible by the number of notes, there is no difference in the result whether using the top or bottom weighted divisi method.

Overflow situations can occur in subtractive or additive divisi, but they require somewhat different processing in each case. Subtractive divisi overflow is handled by Process 3; this is what must occur when there are more notes than there are available paths (or channels) to play those notes. The same overflow procedure handles top or bottom weighted subtractive divisi, and this procedure is more complex than the non-overflow procedures; it is revealed in FIGS. 5*a*, 5*b*, 5*c*, 6*a* and 6*b*. Since the number of notes exceeds the number of channels, there must be at least one channel (path) that will play more than a single note. Process 3 allows for each channel to potentially receive a "group" of notes, although that group may consist of only one note. Still, the process must assign a group of notes to each channel.

Referring to FIG. 5*a*, lists and variables are initialized and organized in 500 through 505, incoming notes detected, counted and listed in 510 and 515, and a list of notes left with a channel index set up in 520 and 525 as the process begins. The first thing to do in Step 1 is to compute the size of each note group—not necessarily which notes are in the group, just how many groups there are and how many notes are in each group. This computation occurs in 530 through 560. There are as many groups as there are channels, and so by examining the number of notes and iterating a process of division and group sizing, we come up with how many notes must be in each of the groups. Since a note cannot be "split"—it must be played by one or another channel—step 550 rounds up in the event the division of 545 creates a non-integer result. As soon as all the notes have been accounted for (not actually allocated, but used to calculate note group sizes), 530 returns a No and the procedure moves on to Step 2.

In FIG. 5*a*, Step 1 the number of groups and the number of notes per group (i.e., per available channel) were determined, but not the specific channels or specific notes to be associated with on another. Steps 2 through 4 in FIG. 5*b* organize the association of specific notes to groups by building what is essentially a two-dimensional array that contains a set of distinct note lists, one list per each channel. Step 2, 565 through 580, simply initializes the flags in the array so that all notes are shown as not yet being assigned to any note group. Once that's done, 570 returns a No and the procedure moves to Step 3 where the individual note groups are actually created (i.e., where the previously determined size groups are now populated by allocating specific notes to specific channels). In 585 the index is initialized to begin with the first group and test 590 checks to see if there are any more groups to be populated with notes. If the test returns a Yes then it finds the size (number of notes) of the current group being populated in 600, and in 605 it we parses the entire list of notes yet to be played (i.e., those not yet flagged as having been assigned to a group) to see which contiguous set of notes that number the same as the group size span the smallest (narrowest) range of pitches. One method for performing this step by calling up an entire subsidiary procedure, is revealed in detail in FIGS. 6*a* and 6*b*. According to this example, when one instrument (or one cluster of instruments) is going to play multiple notes, those notes should be close together in pitch. So for example if there are 8 notes being played, but only 3 paths (channels) then two channels will have to play 3 notes each, and one will have to play 2 notes; the "find narrowest grouping" procedure then looks to see which set of 3 contiguous notes is narrowest in pitch if the process is working on one of the 3-note groups, and it assigns them to the group of 3 notes being "populated." This process is explained in more details below with reference to FIGS. 6*a* and 6*b*. In 610 the note group is "attached to" or associated with the narrowest contiguous collection of notes from 605, an index is reset in 615, and then in 620 through 635 the notes that were just attached to a group are flagged as having been assigned so those notes are not considered in subsequent parses of "narrowest notes" for subsequent groups to be populated. In 625 a test is made to see if all the notes in the current group have been flagged, and if they have, then a group index is incremented in 645 and the procedure cycles back to test 590 to see if any further groups remain to be populated with notes. If No returns, the process moves on to Step 4 at 650.

Step 4 is a simple sorting of the list of the groups from top (highest pitched note(s)) to bottom (lowest pitched note(s)). Once this has been accomplished, the groups are ready to be played in the next step. FIG. 5*c* shows Step 5, the playing of the notes for each group (i.e., notes played by each instrument or collection of instruments addressed on a single divisi path). After initializing the channel counter in 660 to begin with the first channel, test 665 checks to see if there are any channels yet to be played. Of course there are in the first test so with a Yes returned, the information for playing the first set of notes (i.e., the first group to be played) is assembled in 670 through 680. Test 685 checks to determine if any of these notes has yet to be played, which of course returns a Yes the first time through and in 690 an index points to the current note which is played in either 695 or 697, that is the note is played with a normal or a soft attack, as directed by test 692 which checks the status of the soft attack flag. The note index increments in 700, the process cycles back to test 685 and if there are more notes to be played, the process continues to increment through them and play them in 690 through 700. When test 685 indicates all the notes in the group have been played, returning a No, then the channel number is incremented in 705 (indicating we're going on to the next group), and test 665 checks to see if any more channels have yet to be played if so, the whole cycle of Step 5 continues, and if a No returns then the main procedure for this process is ended in 710. In other words, all notes in all groups have been played.

FIG. 6*a* is the first of two diagrams showing the subsidiary procedure for actually figuring out which of the available notes comprise the narrowest grouping when two or more notes are to be played by the same channel in a subtractive divisi with overflow, as alluded to very briefly in 605 of FIG. 5*b*. Here we first initialize the variable NarrowestPitchRange in 800 to be an arbitrarily high value (the widest range possible in the context of 128 possible MIDI note values), and we initialize the NarrowestPitchRangeIndex 805 to minus 1 so it points to nothing, and the NoteGroupSize 810 is initialized to zero. We then begin the procedure to figure out which notes comprise the narrowest set of notes for the current group. Test 815 checks to see whether the group is comprised of at least two notes; if not, then "narrowest" doesn't really mean much since there is only one note, and the procedure jumps to FIG. 6*b*, column "A" where either test 960 determines there are no more notes left to be assigned, or loop 965 through 990 finds the first note which is not yet assigned and assigns it to the group (a group of one) then flags that note as having been used. Thereafter test 960 will find there are no more notes to assign and end the subroutine at 995.

If the test in 815 indicates the group is more than one note, then an outer loop limit is set in 820, an index set in 825, and test 830 checks to see if the looping index has yet incremented to indicate all possible note sets have been evaluated for this particular group size; of course in the first test this isn't so and a Yes is returned. Initialization of the current test for the first set of notes spanning the current group size is now done; the pitch range of the current group is set to zero in 835, the grouping flag to valid in 840, and the inner note index and inner loop limit are set in 845 and 850. This prepares the stage for parsing the list of available notes (starting at the highest pitch or highest MIDI number) to determine the range of pitches covered by the number of notes in the group. In 855 a test is made to see if there are any more note groupings to be evaluated. Of course there are in the first pass so a Yes is returned and we go to procedure 860 through 880. In test 860 we look at the note to which the index points, and to the next note in the list and if either one has been assigned to a group already, we set the valid grouping flag to be false in 865, then go to 870; if neither note has been assigned to a group, we go directly to 870 and there we calculate the pitch spread for this pair of notes. In 875 we add that range to whatever range has already been established (it began at zero from 835) and in 880 we increment an index, return to 855, and test to see if more notes have yet to be tested for this group size within the current list position. If Yes, we repeat 860 through 880, thus increasing the pitch range by the additional "spread" of the next note. As soon as test 855 returns a No we can store that pitch range in a list and then set some indices to continue checking for the next possible pitch range value based on starting in the next note of the list. In loop 900 through 920, we increment down the list of available notes and return to 830 where we repeat the process of calculating the pitch range across the span of notes equal to the group size, storing that result and so forth.

When all possible sets of notes in the list have been parsed to calculate the pitch range for the current group size, test 830 will return a No, and the procedure jumps to the procedure in column "B" of FIG. 6*b* whereby the actual narrowest pitch range set of notes for the current group is established. A given pass through the processing of FIG. 6*a* will either branch to FIG. 6*a* column "A" (when there is a single-note group) or to column "B" (when there is a group of 2 or more notes). So it is from column "A" or "B" that the END occurs once the group has been assigned its note(s). In column "B" test 1000 checks to see if the Narrowest Pitch Range Index is not equal to −1. If it is equal to −1, No returns to indicate there are no more notes to handle and the procedure ends in 1005. Otherwise Yes returns and some values are initialized in 1010 and 1015 to set up a note allocation loop whereby notes from the now-established narrowest range within the list of notes are actually assigned to the current group. In test 1020 a test is made to see if any more notes are left to be assigned to the current group. If they are Yes returns and in 1030 through 1040 the note is assigned, the index increments in 1045, and the loop repeats until all the sequential notes in this sized group are assigned to the current group, at which point test 1020 goes to No and the procedure ends at 1025. At this point the Narrowest Grouping of more than one note has been established and populated.

Additive divisi can be used for creative effects within a single type of instrument (a single section of like instruments) or for orchestrational assignment of notes to multiple sections of instruments. If one were using additive divisi in a single section, it would assign one note to the first path, the second note to the next path, and so forth. However, additive divisi may be used to address multiple sections of instruments, and such sections can be set with specific "priority" values. Paths (sections) with a priority of "one" will play when one note is played. Paths (sections) with a priority of "two" will play when a second note is played, and so forth. If multiple paths share the same priority, these paths will all be allocated the same note(s). The point is that unlike subtractive divisi where a constant number of paths is always addressed and these are allocated among whatever number of notes are played, additive divisi increases the number of paths played as the number of notes played increases, up to the point where the number of notes equals the available number of priorities. The key to Additive Divisi is that it provides an ordering procedure for sequentially joining instruments into a composition. Additive Divisi with Overflow provides the means for distributing notes when the number of notes exceeds the number of additive priority settings one has established for the additive divisi. Once overflow occurs, subtractive divisi may be invoked which is why we retain the term "divisi" for the additive process.

The additive divisi process (without overflow) is depicted in Process 4 as shown in FIG. 7. This process only applies when the number of notes played is less than or equal to the number of priorities available to play them; otherwise we use Process 5 which includes provisions for note overflow (per FIGS. 8 and 9). Initially the list of notes is sorted by pitch and a pointer is aimed at the first note in 1100 and 1105. Then a test is made to see if any notes remain to be processed in 1110 which, at least on the first pass is going to return a Yes. The first check is done to see which priority 1 paths need to be assigned as set up with 1120 through 1130 where, since the note index has been set at 1, and the current priority is matched to the note index, priority 1 paths are first to be processed for potential note assignments. In 1135 we test to see if any more paths have yet to be processed, and on the first pass through the process this too will be true and a Yes will be returned, so we go on to the test of 1140 where we see if the current path priority is equal to the priority we're wanting to allocate. If it is, Yes returns and we distribute the current note to that path. This means that whatever instruments or players (or desks of instruments/players) are on the current path are all now going to play the assigned note in 1145; it could be many instruments or a solo instrument. It could also be an entire section of instruments such as "first violins." Since the Number Of Notes to be played is less than or equal to the Number Of Paths at this point, there is no subtractive divisi among instruments. (In the overflow situation described in Process 5, there may be subtractive divisi within a section as part of the additive process). We then increment the path index in 1150. If the test of 1140 indicates the path priority is not equal to the priority we're wanting to allocate, then a No returns, we don't distribute notes and instead we go directly to 1150 and increment the path index. After 1150 the procedure loops back to test 1135. As long as the path index is less than or equal to the number of paths (with the current priority) the process of 1135 through 1150 will continue to allocate the current note to each such path. When 1135 returns a No, this indicates all paths with the current priority have had the note allocated to them, so the Note Index increments in 1155, and the procedure loops back up to 1110 to test if any more notes remain to be processed. A Yes continues through the allocation process of 1120 through 1150 allocating the next note to whatever paths have the next priority value, and a No indicates all notes have been allocated and the process ends with 1115.

Additive divisi overflow differs from subtractive divisi overflow in that it's not defined by having more notes than paths, but by having more notes than priorities. Each path is assigned a priority, but these are not exclusive; multiple paths can share the same priority. So for example consider a situation with 4 notes and 4 paths. In subtractive divisi this would not run into overflow, but in additive divisi it might, depending upon whether two or more paths share the same priority. If the paths are set such that there are only 1 or 2 or 3 priorities, then the 4 notes would exceed the number of priorities and an additive divisi overflow condition would exist. If each path had a different priority, then overflow would not occur. The procedure for additive overflow is depicted by Process 5 in FIGS. 8*a*, 8*b*, 8*c*, 9*a* and 9*b* and is very similar to that for subtractive divisi. In fact, the major differences are (a) a lack of concern for top versus bottom weighting, and (b) tests which look for the number of available priorities rather than the number of available paths. Because the procedures are otherwise almost the same as those described for FIGS. 5*a*, 5*b*, 5*c*, 6*a* and 6*b* we won't discuss them step-by-step here.

FIGS. 10A and 10B show how subtractive divisi processes deal with notes released from a held chord, as contrasted to the initiation of a new note or chord. This process applies to all subtractive divisi methods (whether top or bottom weighted, with or without note overflow), but not to any additive divisi methods. The concept is that in subtractive divisi, as soon as one or more notes is being played, all available paths (channels) are instructed to play, i.e., to sound a note. The specific allocations of channels to notes is, of course, the nature of the subtractive divisi methods just described herein. There is a situation, however, that occurs when a chord (i.e., a group of two or more simultaneously sounding notes) is being played, and then a subgroup, i.e., at least one of those notes, is released (no longer played) while at least one remainder note of the group continues to sound. In this case, the channels (paths) that had been previously allocated to the subgroup of released note(s) are no longer playing those notes. Correct ensemble behavior, that is correct orchestration, calls for these now disused channels to be quickly reassigned to play whatever note(s) remain in play from the existing chord. Therefore, it is desirable to re-parse the remaining note(s) and determine which channels will now play them. However, it would not be musically desirable to simply issue new note-on commands to any reallocated channels; as doing so would cause a fresh "attack" for all such reallocated channels, and the effect would be as though the existing notes were played again. That is, instead of a piano player holding down a key after letting up other fingers, it would be as if he or she let go of all the keys then came back down on the key(s) that were intended to continue sounding.

The non-musically correct rejoining of reallocated channels to notes still in play would occur if all notes initiated with a normal attack, which might also be described as a "hard attack," although in some cases it's not especially hard or sudden. Live musicians who play in ensemble, for instance a section of violinists, naturally control their playing style when they abandon a released note of a chord and join other players who are continuing to play existing notes. In such cases, the players who are joining the remaining notes will softly begin playing the new (for them) notes. A violinist therefore would softly begin stroking the strings with the bow, and build up to the desired intensity instead of using a sudden and strong bow motion. A trumpet player might softly blow without tongue accentuation, building up his breath to strengthen the note so it seamlessly joins other trumpeters. A musical synthesizer or sampler can be set up to have both normal and soft-attacked notes using various means, but such notes must be invoked appropriately if the musicality of reallocated channels upon note release is to be achieved. The process of Step 10, illustrates one example of how to instruct the synthesizer or sampler which type of note attack to use, normal or soft. Functionally, Step 10 may be placed at the start in the sequence of events, but it is described here last because it is easier to do so after the initial divisi processes has been described.

In the example of FIGS. 10A and 10B, the soft attack/normal attack designation process involves setting up four new arrays 1800, which can be thought of as indexed matrices in which values are stored or altered during the soft attack processing. Moreover, three lists are generated by counting the items as they are used to populate three of these arrays: the count of how many notes have just been released is based on how many notes are in the ListOfNotesOff and is saved as a variable NumberOfNotesOff, the count of how many notes have just been placed in the ListOfNewNotesOn is saved as the variable NumberOfNewNotesOn, and the count of how many notes are in the ListOfNotesSounding is saved as the variable NumberOfNotesSounding.

Starting at 1805, the process initializes all the ListOfSoftAttacks flags as being false in the process of loop 1810 through 1820, after which the next loop of steps from 1825 through 1875 examines the ListOfNotesOff and removes these notes from the ListOfNotesSounding in order to generate an updated list of those notes still playing. It also removes the notes off from the ListOfSoftAttacks. When all the ListOfNotesOff has been processed, test 1830 in FIG. 10A returns a No and the ensuing loop in FIG. 10B of 1880 through 1895 sets all remaining ListOfNotesSounding (after the NotesOff have been removed) to have soft attack flags. When all the ListOfNotesSounding has been processed, test 1885 returns a No and the procedure moves on to step 1900.

Step 1900 and 1905 set the NoteIndex and NoteOnIndex values so that test 1910 can determine if any NewNotesOn remain to be processed. If there are any remaining new notes on, a Yes returns and loop 1910 through 1935 iterates through the ListOfNewNotesOn assigning false values to the soft attack flags (1930) for any new notes. This is because if a new note is being sounded, any channel(s) subsequently assigned to play such a note should play with a normal attack. When no NewNotesOn remain to be processed, test 1910 returns a No and the assignment of true or false "soft attack" flags has been completed. At this point the ListOfNotes is sorted 1940 according to pitch (highest numbered notes by MIDI value have the highest pitch) and this sorted list becomes the new ListOfNotes used by the subsequent processes for channel allocation. The soft attack determination process ends at 1945.

FIG. 11 is a block diagram illustrating another embodiment of a note allocation processor according to the invention. The note allocation processor 1102 of FIG. 11 is somewhat different from note allocation processor 102 of FIG. 1 and is more suitable for performing the note allocation processes illustrated in FIGS. 4A-10B. Most notably, note allocation processor 1102 of FIG. 11 lacks note assignment tables; rather, the note allocation processor 1102 performs channel allocation according to the processes described with reference to FIGS. 4A-10B, using various counters and registers. To illustrate, concurrent reference is made to the process of FIGS. 4A-4B and to FIG. 11. When the soft attack feature is used, at step 400 the CPU 1104 assigns the attack flags 1150. Then, at step 402 the CPU 1104 sets the channel register 1130 to the total number of available paths. This may depend on the input device, the player, or user's choice. At step 405 the CPU 1104 sets channels left register 1145 to equal the value in channel register 1130. At step 410 the CPU 1104 lists the channels according to priority in channel list register 1135. At step 415 CPU 1104 detects the total number of notes to be played simultaneously and sets that number in notes register 1105. Then the CPU 1104 sets current note register 1120 to value 1 at step 420, and lists the notes according to pitch order in notes list register 1115 at step 425. At this point all of the values in the various registers are ready for the CPU 1104 to begin the process of Step 1, i.e., the process beginning with step 430. In the process of FIGS. 4A and 4B, it is shown that the current channel register 1140 is initialized to 1 at step 470, i.e., after the process starting at step 430 is completed. However, it should be appreciated that this can be performed before step 430.

It should be noted that when performing overflow processing, CPU 1104 also initializes the notes left register 1125 to equal the value in the notes register 1105, as exemplified in FIG. 5A, step 520. However, this step can be performed anytime at a beginning of a process when the CPU 1104 initializes the registers.

While the invention has been described with reference to particular embodiments thereof, it is not limited to those embodiments. Specifically, various variations and modifications may be implemented by those of ordinary skill in the art without departing from the invention's spirit and scope, as defined by the appended claims.

We claim the following:

1. A process for assigning notes to be voiced by selected channels, comprising:

examining in real time all notes that are to be voiced simultaneously;

using a predefined iterative process to assign specific channels from channels available to voice the notes to specific notes to be played;

wherein said iterative process comprises selecting a first note from the notes to be voiced and using a predefined assignment process to assign the number of channels to play the first note and to allocate any remainder channels to be assigned in subsequent operations of said iterative process.

2. The process of claim 1, wherein said iterative process further comprises a step of arranging the notes to be voice according to a predefined order.

3. The process of claim 2, wherein said order is according to ascending pitch of said notes.

4. The process according to claim 3, wherein the first note is selected as the highest pitch note in said order, and wherein subsequent iterations select consecutive notes according to descending pitch order.

5. The process according to claim 3, wherein the first note is selected as the lowest pitch note in said order, and wherein subsequent iterations select consecutive notes according to ascending pitch order.

6. The process according to claim 3, further comprising assigning priority level to each of said channels.

7. The process according to claim 6, wherein the first note is assigned to the channel having the highest priority level, and subsequent iterations assign notes to consecutive channels according to descending priority levels.

8. The process according to claim 6, wherein when the number of notes to be sound is larger than the number of channels available to play all notes, the assignment proceeds according to the iterative process until all of the channels have been assigned to at least one note and remaining notes are assigned to channels according to priority levels of said channels.

9. The process of claim 1, further comprising examining in real time whether a release note event occurs, said release note event constituting an instruction to cease voicing a subgroup of the notes to be voiced simultaneously, and if a release note event occurs, using a predefined reassignment process to assign a remainder note from said notes to be voiced simultaneously to a channel previously voicing a note from said subgroup.

10. The process according to claim 9, wherein said reassignment process is an iterative process that starts with the highest pitch note, and wherein subsequent iterations select consecutive notes according to descending pitch order.

11. The process according to claim 10, wherein said reassignment further comprises an indication of soft attack, said soft attack indication comprising an instruction to sound the note by gradually increasing its amplitude.

12. The process according to claim 9, wherein said reassignment process is an iterative process that starts with the lowest pitch note, and wherein subsequent iterations select consecutive notes according to ascending pitch order.

13. The process according to claim 12, wherein said reassignment further comprises an indication of soft attack, said soft attack indication comprising an instruction to sound the note by gradually increasing its amplitude.

14. The process according to claim 1, further comprising:

for each composition to be played, setting the number of channels available to remain fixed throughout the composition; and, wherein when the number of notes to be sound is larger than the number of channels available to voice the notes, repeating the predefined assignment process until all of the channels have been assigned, and ignoring any remaining notes thereafter.

15. The process according to claim 1, wherein upon receiving a new note instruction, the process further comprises performing a further iterative process to select for each channel one of the following actions:

i. continue to play the same note;

ii. play a newly assigned note;

iii. play a note that has been previously assigned to another channel;

iv. play no note.

16. A method for emulating an orchestration of a musical piece, comprising:

defining a plurality of orchestra sections, each section comprising a predefined number of instruments;

obtaining note samples using subsections of each of the orchestra sections;

assigning a fixed number of channels to each of said orchestra sections, wherein for each orchestra section said fixed number is equal to the predefined number of instruments;

continuously performing a real time examination for note instruction input from an input device; and, upon receiving an sound input from the input device, performing an iterative assignment process to assign each of said fixed number of channels to sound at least one of said note samples.

17. The method of claim 16, wherein when said note instruction input comprises a plurality of notes to be played simultaneously, the method further comprises ordering the notes to be played simultaneously according to pitch order prior to performing the iterative assignment process.

18. The method according to claim 17, wherein when said note input comprises a new note instruction, the method further comprises performing a further iterative process to select for each channel one of the following actions:

i. continue to play the same note;

ii. play a newly assigned note using a hard attack;

iii. play a note that has been previously assigned to another channel using a soft attack;

iv. play no note.

19. The method according to claim 17, wherein when the new note instruction comprise a note release input for a currently playing note, the method further comprises:

determining whether any notes are still to be played and, if so, using a reassignment iterative process to reassign any channel playing the currently playing note to play one of the notes still to be played, to thereby having said channels play the notes still to be played using a soft attack.

* * * * *